US010532246B2

(12) United States Patent
Liao et al.

(10) Patent No.: US 10,532,246 B2
(45) **Date of Patent: *Jan. 14, 2020**

(54) STATIONARY EXERCISE APPARATUS

(71) Applicants: Hung-Mao Liao, Taichung (TW); Joe Chen, Taichung (TW)

(72) Inventors: Hung-Mao Liao, Taichung (TW); Joe Chen, Taichung (TW)

(73) Assignee: Johnson Health Tech Co., Ltd., Taichung (TW)

( * ) Notice: Subject to any disclaimer, the term of this patent is extended or adjusted under 35 U.S.C. 154(b) by 57 days.

This patent is subject to a terminal disclaimer.

(21) Appl. No.: 15/784,203

(22) Filed: Oct. 16, 2017

(65) Prior Publication Data

US 2018/0036582 A1 Feb. 8, 2018

Related U.S. Application Data

(63) Continuation-in-part of application No. 15/394,857, filed on Dec. 30, 2016, now Pat. No. 9,808,667, which is a continuation-in-part of application No. 15/095,901, filed on Apr. 11, 2016, now Pat. No. 10,369,403, which is a continuation of application No. 13/782,798, filed on Mar. 1, 2013, now Pat. No. 9,339,684, which is a continuation of application No. 13/335,437, filed on Dec. 22, 2011, now Pat. No. 8,403,815, which is a continuation of application No.

(Continued)

(30) Foreign Application Priority Data

Nov. 4, 2005 (CN) ..... 2005 1 0115518
Jul. 27, 2006 (CN) ..... 2006 1 0103811

(51) Int. Cl.

| | |
|---|---|
| ***A63B 22/00*** | (2006.01) |
| ***A63B 24/00*** | (2006.01) |
| ***A63B 22/04*** | (2006.01) |
| ***A63B 21/22*** | (2006.01) |
| ***A63B 21/00*** | (2006.01) |
| ***A63B 22/06*** | (2006.01) |

(52) U.S. Cl.

CPC ..... *A63B 22/001* (2013.01); *A63B 21/225* (2013.01); *A63B 21/4034* (2015.10); *A63B 22/0015* (2013.01); *A63B 22/04* (2013.01); *A63B 22/0664* (2013.01); *A63B 24/00* (2013.01); *A63B 22/0023* (2013.01); *A63B 2022/067* (2013.01); *A63B 2022/0676* (2013.01); *A63B 2225/09* (2013.01)

(58) Field of Classification Search

None

See application file for complete search history.

(56) References Cited

U.S. PATENT DOCUMENTS 7,682,290 B2 * 3/2010 Liao ..... A63B 22/001 482/51
7,972,248 B2 * 7/2011 Liao ..... A63B 22/001 482/51

(Continued)

*Primary Examiner* — Stephen R Crow

(57) ABSTRACT

A stationary exercise device having variable footpaths is disclosed. The exercise device includes a frame, a pair of supporting members that have a first end to rotate about an axis and a second end to move along a reciprocating path, a pair of pedals joined to the supporting members, and a guider assembly for adjusting an incline angle of the reciprocating path.

6 Claims, 29 Drawing Sheets

Related U.S. Application Data

12/773,849, filed on May 5, 2010, now Pat. No. 8,092,349, which is a continuation of application No. 11/497,783, filed on Aug. 2, 2006, now Pat. No. 7,722,505, which is a continuation-in-part of application No. 11/434,541, filed on May 15, 2006, now Pat. No. 7,682,290.

(56) References Cited

U.S. PATENT DOCUMENTS

| | | | | |
|---|---|---|---|---|
| 2017/0014675 | A1* | 1/2017 | Lai | A63B 22/0664 |
| 2018/0036582 | A1* | 2/2018 | Liao | A63B 24/00 |

* cited by examiner

STATIONARY EXERCISE APPARATUS

CROSS-REFERENCE TO RELATED APPLICATION

This application is a continuation-in-part of U.S. patent application Ser. No. 15/394,857, filed on Dec. 30, 2016, which is a continuation-in-part of U.S. patent application Ser. No. 15/095,901, filed on Apr. 11, 2016, which is a continuation of U.S. patent application Ser. No. 13/782,798, filed on Mar. 1, 2013, now U.S. Pat. No. 9,339,684, which is a continuation of U.S. patent application Ser. No. 13/335,437, filed on Dec. 22, 2011, issued as U.S. Pat. No. 8,403,815 on Mar. 26, 2013, which is a continuation of U.S. patent application Ser. No. 12/773,849, filed on May 5, 2010, issued as U.S. Pat. No. 8,092,349 on Jan. 10, 2012, which is a continuation of U.S. patent application Ser. No. 11/497,783, filed on Aug. 2, 2006, which issued as U.S. Pat. No. 7,722,505 on May 25, 2010, which claims the benefit of Chinese patent application no.: 200610103811.X, filed on Jul. 27, 2006, and is a continuation-in-part of U.S. patent application Ser. No. 11/434,541, filed on May 15, 2006, which issued as U.S. Pat. No. 7,682,290 on Max. 23, 2010, which claims the benefit of Chinese patent application no.: 200510115518.0, filed Nov. 4, 2005, each of which is incorporated by reference in their entireties.

BACKGROUND

1. Field of the Invention

This invention relates to stationary exercise apparatus, and more particularly to stationary exercise apparatus with adjustable components to vary the footpath and enhance exercise intensity of a user.

2. Description of the Related Art

Stationary exercise apparatus have been popular for several decades. Early exercise apparatus typically had a single mode of operation, and exercise intensity was varied by increasing apparatus speed. More recently, enhancing exercise intensity in some apparatus has been made by adjusting the moving path of user's feet, such as by adjusting the incline or stride length of user's foot path.

U.S. Pat. No. 5,685,804 discloses two mechanisms for adjusting the incline of a stationary exercise apparatus, one of them having a linear track which can be adjusted and the other having a length adjusting swing arm. The swing arm lower end can be moved upwardly for a high incline foot path. U.S. Pat. No. 6,168,552 also discloses a stationary exercise apparatus having a linear track for changing the incline of the stationary exercise apparatus. U.S. Pat. No. 6,440,042 discloses a stationary exercise apparatus having a curved track for adjusting the incline of the stationary exercise apparatus.

Nonetheless, there is still a need for an exercise apparatus that can increase varieties of exercise and enhance exercise intensity of a user.

SUMMARY

A stationary exercise apparatus in accordance with present invention includes a frame having a base, first and second supporting members coupled to the frame to rotate about an axis, a guider assembly coupled to the base, and first and second pedals coupled to the first and second supporting members. While operating the stationary exercise apparatus, the first and second pedals move along a closed path that can have a variety of shapes to vary the exercise experience and intensity. The present invention provides: a user of the stationary exercise apparatus with a benefit of high exercise intensity; an inclined foot path; a variable stride length; better gluteus exercise; and a more compact and succinct appearance.

DETAIL DESCRIPTION

Figure 1:
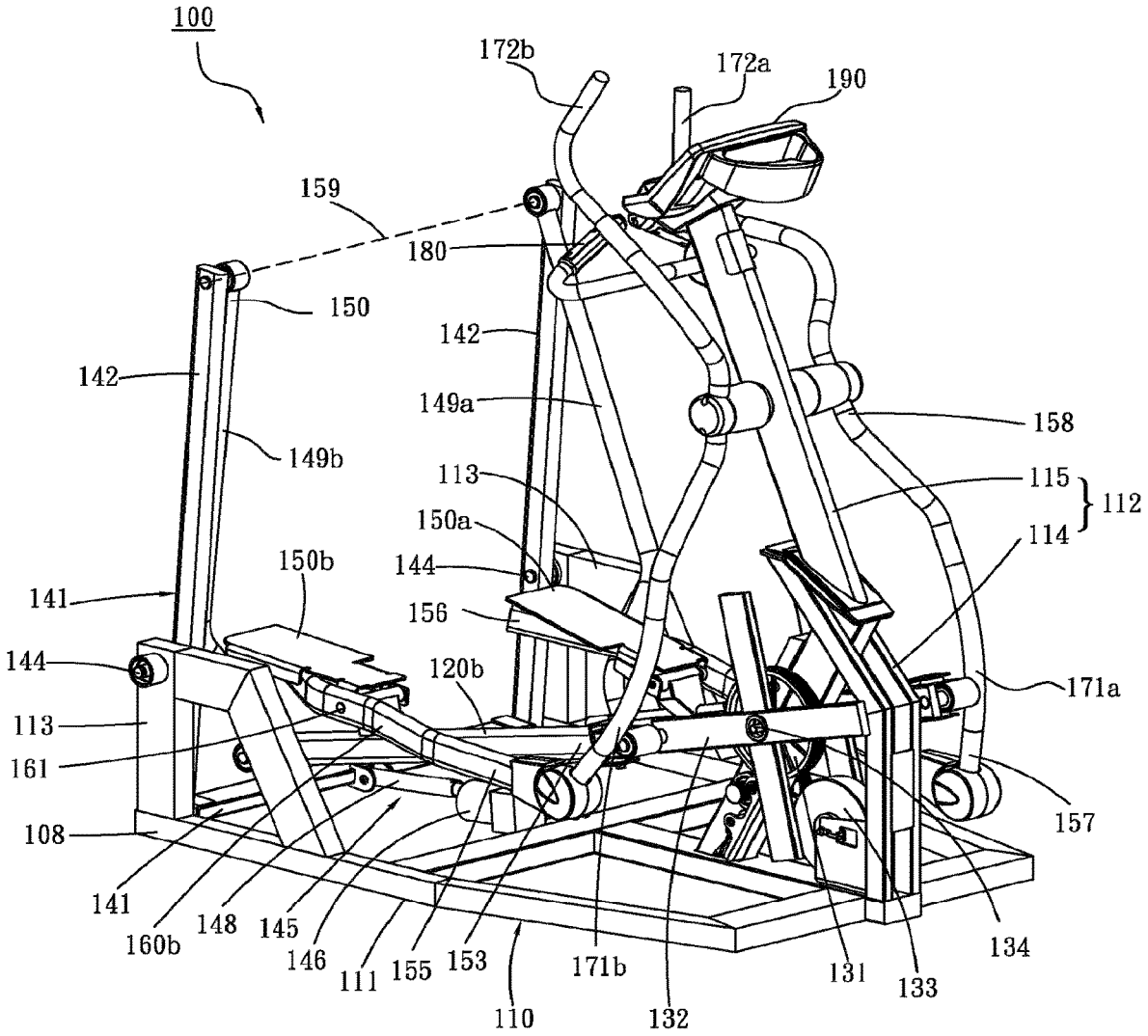
FIG. 1 is a perspective view of a stationary exercise apparatus according to a preferred embodiment of the present invention.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

Now referring to FIG. 1, a stationary exercise apparatus 100 is illustrated therein. The stationary exercise apparatus 100 has a frame 110 generally comprising a base 111, a front portion 112, a rear portion 108, and side portions 113. The base 111 is substantially a horizontal frame adapted to stably rest on a ground, floor or other similar supporting surface. The front portion 112 is fixed on the base 111, and preferably includes a post 114 and a standard 115. The side portions 113 are respectively mounted on the left and right sides of the base portion 111. A fixed handle assembly 180 and a console 190 are mounted on or near the upper end of the standard 115. Left and right cranks 132 (FIG. 2) are each pivoted to one portion of the frame 110 defining a first axis 134 and in the illustrated embodiment, the first axis 134 is at or near the front portion of the frame 110. The left and right cranks 132 could be replaced by a pair of disks, flywheels, or other device rotating about the first axis 134. The left and right cranks 132 and the first axis 134 can also be replaced by a pair of closed tracks circulating about a virtual axis, as opposed to an axis defined by a wheel axle. The frame 110 may further comprise a pulley 131 and a resistance member 133 which is controlled by using the console 190 to vary operating resistance for a user.

Figure 2:
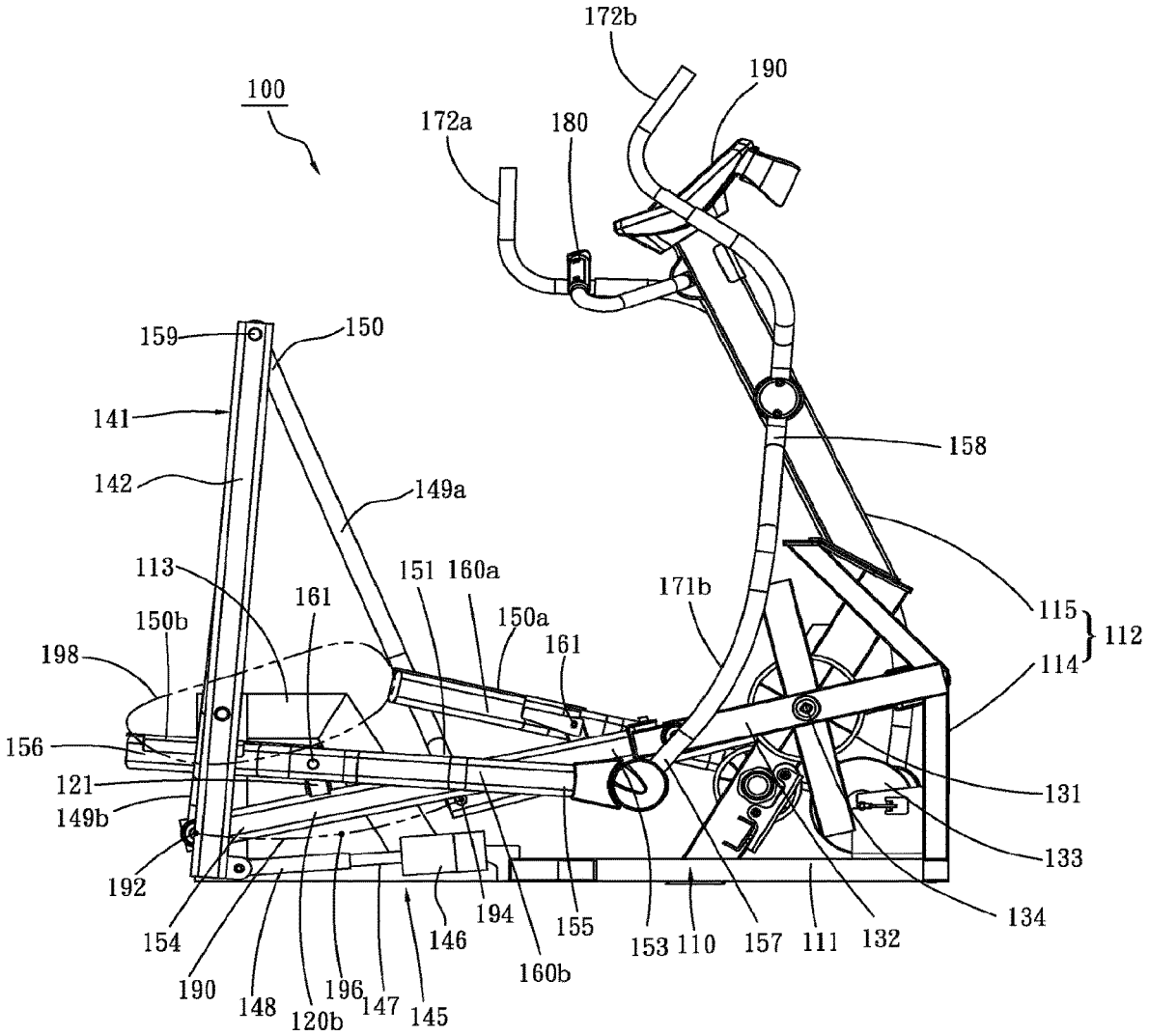
FIG. 2 is a side view of the stationary exercise apparatus of FIG. 1 in a rotating position of a low incline condition.
Figure 3:
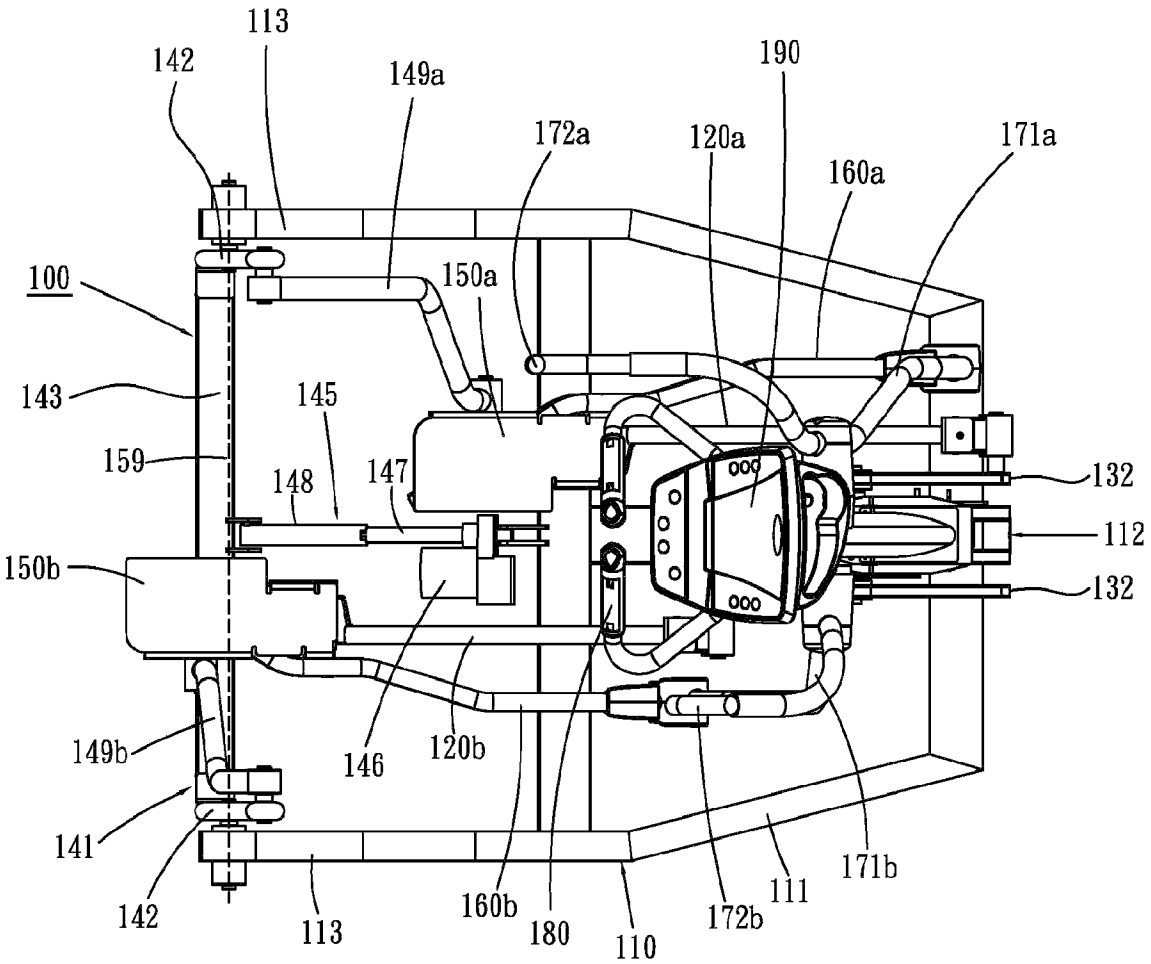
FIG. 3 is a top view of the stationary exercise apparatus of FIG. 1.
Figure 6:
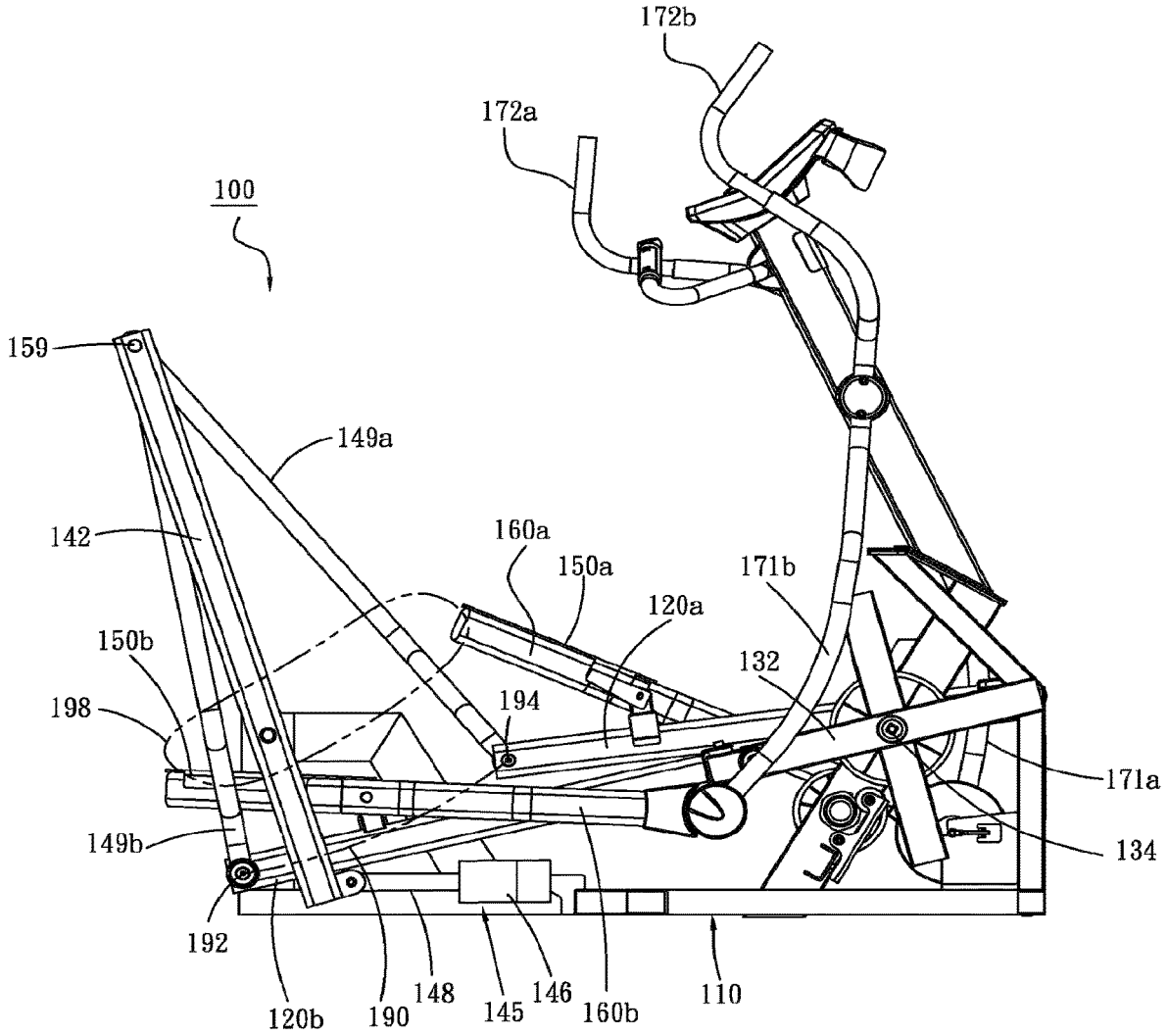
FIG. 6 is a side view of the stationary exercise apparatus of FIG. 1 in a rotating position of a high incline condition.

Now referring to FIGS. 1 and 2, the frame 110 further comprises a moving assembly 141 mounted on the side portions 113 respectively. In a preferred embodiment of the present invention as shown in FIG. 1, the moving assembly 141 has first and second moving members 142, in a generally upright position, and a lateral link 143 (FIG. 4) connecting the first and second moving members 142 to one another. The first and second moving members 142 are joined to the side portions 113 via a second axis 144 so that the upper end portions of the first and second moving members 142 can be adjusted by pivoting the first and second moving members 142 about the second axis 144. There is an optional adjusting assembly 145 mounted between the moving assembly 141 and the frame 110 for adjusting the moving assembly 141 about the second axis 144. The preferred embodiment of the adjusting assembly 145 generally includes a motor 146, a screw rod 147, and a screw tube 148. The motor 146 has one end connected to the base portion 111 and the other end connected to one end of the screw rod 147. The other end of the screw rod 147 is connected to one end of the screw tube 148. The other end of the screw tube 148 is connected to the moving assembly 141 so that the effective length of the screw rod 147 and the screw tube 148 combination is adjustable to move the lower end of the first and second moving members 142 fore and aft. As the lower ends move, the upper ends of the first and second moving members 142 are pivoted in the opposite direction about the second axis 144. The upper end portions of the first and second moving members 142 are adjustable anywhere between a first position as shown in FIG. 2 and a second position as shown in FIG. 6. Although described and illustrated as a screw adjusting mechanism, the adjusting assembly 145 could be any manual or automatic mechanical, electromechanical, hydraulic, or pneumatic device and be within the scope of the invention. The adjusting assembly 145 is illustrated as being mounted on the right side of the exercise device 100, but both moving members 142 are adjusted because the lateral link 143 (FIG. 4) transfers the force to the left side moving member 143.

Figure 4:
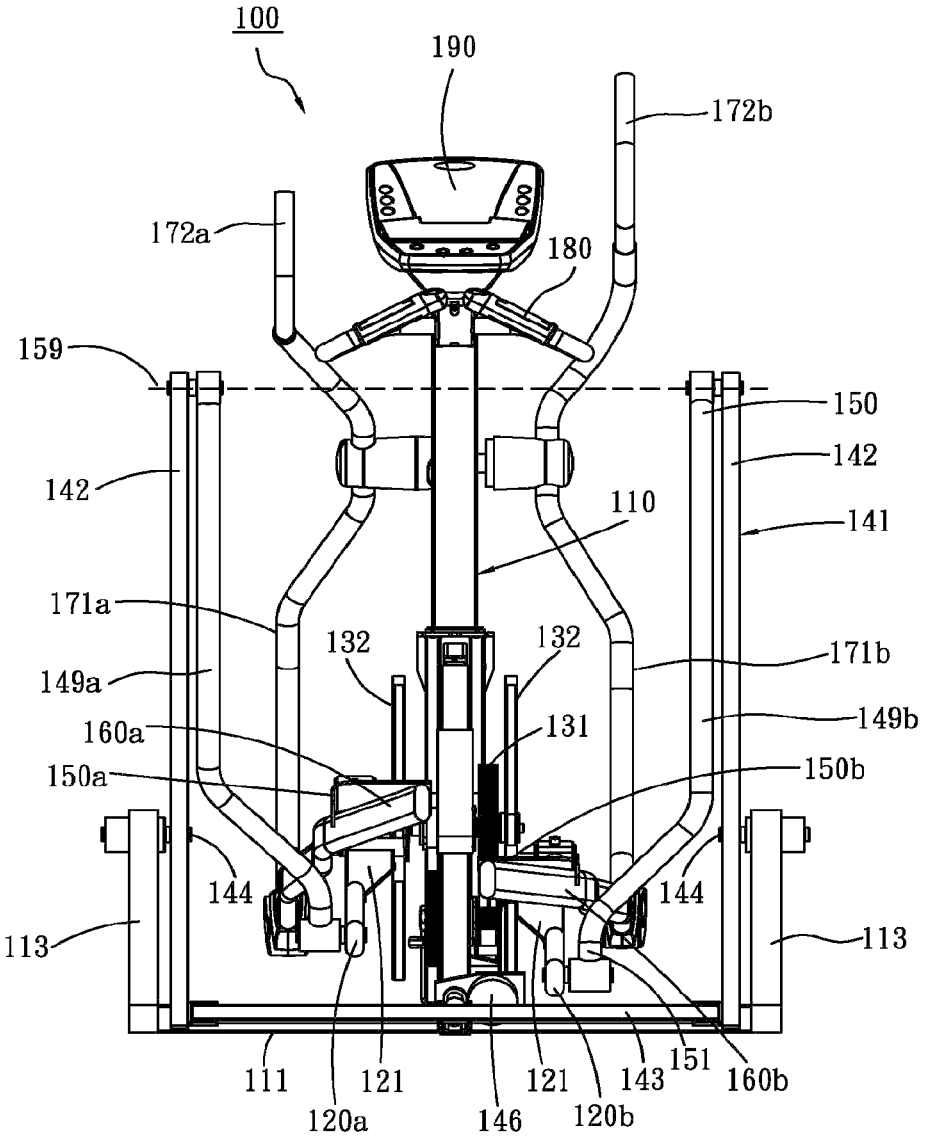
FIG. 4 is a back view of the stationary exercise apparatus of FIG. 1.

Referring to FIGS. 2 and 4, the stationary exercise apparatus 100 comprises first and second swing members 149*a*/149*b*, each of the swing members 149*a*/149*b* having an upper portion 150 and a lower portion 151. The upper portions 150 of the first and second swing members 149*a*/149*b* can be coupled to the frame 110 via a swing axis 159 for swinging motion relative to the frame 110. In the preferred embodiment of the present invention, the upper portions 150 of the first and second swing members 149*a*/149*b* are respectively pivoted to the first and second moving members 142 via the swing axis 159 so that the swing axis 159 can be adjusted forward or backward anywhere between the first position shown in FIG. 2 and the second position shown in FIG. 6. Different positions of the swing axis 159 cause different exercise intensity of the stationary exercise apparatus 100.

Figure 5:
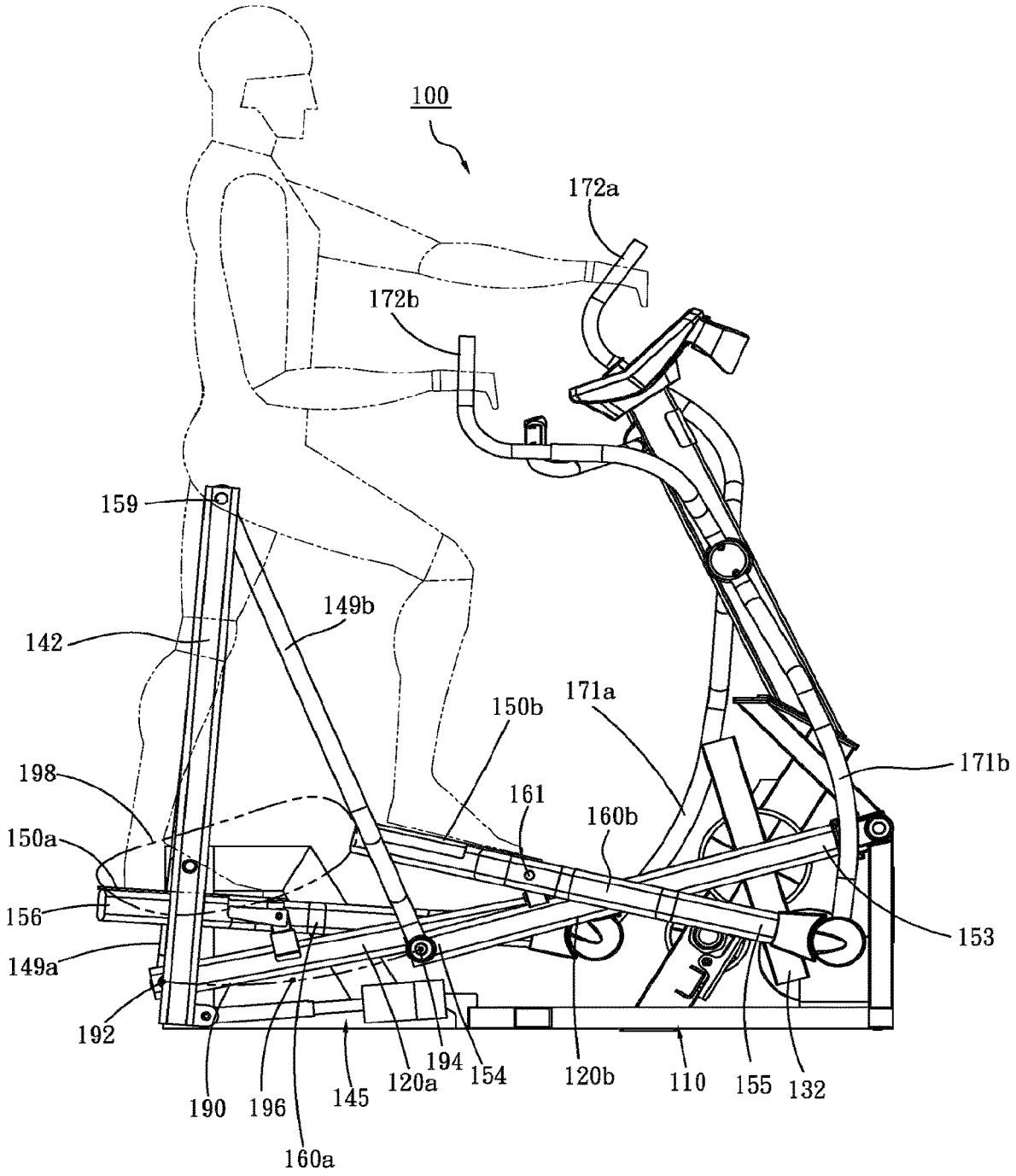
FIG. 5 is a side view of the stationary exercise apparatus of FIG. 1 in another rotating position of the low incline condition.

Now referring to FIGS. 2, 4 and 5, the stationary exercise apparatus 100 comprises first and second supporting members 120*a*/120*b*, each of the first and second supporting members 120*a*/120*b* having a first end portion 153 and a second end portion 154. The first end portions 153 of the first and second supporting members 120*a*/120*b* are respectively coupled to the frame 110 to rotate about the first axis 134. In the preferred embodiment of the present invention, the first end portions 153 of the first and second supporting members 120*a*/120*b* are respectively pivoted to the left and right cranks 132 to rotate about the first axis 134. As mentioned previously, the left and right cranks 132 may be replaced by flywheels or disks and the like. The second end portions 154 of the first and second supporting members 120*a*/120*b* are respectively pivoted to the lower portions of the first and second swing members 149*a*/149*b* so that the second end portions 154 of the first and second supporting members 120*a*/120*b* may be moved along a reciprocating path 190 (as shown in FIGS. 2 and 5) while the first end portions 153 of the first and second supporting members 120*a*/120*b* are being rotated about the first axis 134.

Referring to FIGS. 1 through 6, the stationary exercise apparatus 100 further comprises first and second control links 160*a*/160*b* respectively pivotally connected to the first and second supporting members 120*a*/120*b*. Each of the first and second control links 160*a*/160*b* has a first end portion 155 and a second end portion 156. The first end portions 155 of the first and second control links 160*a*/160*b* are movably coupled to the frame 110. In the preferred embodiment of the present invention, the first end portions 155 of the first and second control links 160*a*/160*b* are respectively connected to first and second handle links 171*a*/171*b*. More specifically, each of the first and second handle links 171*a*/171*b* has lower and upper end portions. The lower end portions 157 of the first and second handle links 171*a*/171*b* are respectively pivoted to the first end portions 155 of the first and second control links 160*a*/160*b* and the upper end portions 158 of the first and second handle links 171*a*/171*b* are pivoted to the frame 110 so that, the first and second handle links 171*a*/171*b* can guide the first end portions 155 of the first and second control links 160*a*/160*b* in a reciprocating path. There are several alternatives of performing the same function of the first and second handle links 171*a*/171*b*. For example, the frame 110 can include a pair of tracks allowing the first end portions 155 of the first and second control links 160*a*/160*b* movably coupled to the tracks via rollers or sliders. For simplicity, all such alternatives are referred to herein as "handle links" even when they do not serve as handles for the user.

Still referring to FIGS. 1 through 6, the stationary exercise apparatus 100 includes first and second pedals 150*a*/150*b* respectively coupled to the first and second supporting members 120*a*/120*b*. In the preferred embodiment of the present invention, the first and second pedals 150*a*/150*b* are indirectly connected to the first and second supporting members 120*a*/120*b*. More specifically, the first and second pedals 150*a*/150*b* are respectively attached to the second end portions 156 of the first and second control links 160*a*/160*b* which are pivotally connected to the first and second supporting members 120*a*/120*b*. Therefore, rear end portions 158 of the first and second pedals 150*a*/150*b* are directed by the first and second supporting members 120*a*/120*b* to move along a second closed path 198 (FIGS. 2, 5, and 6) while the first end portions 153 of the first and second supporting members 120*a*/120*b* rotating about the first axis 134. The first and second pedals 150*a*/150*b* can also be directly attached to the first and second supporting members 120*a*/120*b*, similar to the teaching of U.S. Pat. No. 5,685,804. It should be noticed that both indirect and direct connections between the first and second pedals 150*a*/150*b* and the first and second supporting members 120*a*/120*b* can cause the rear end portions of the first and second pedals 150*a*/150*b* to move along similar closed paths, and are within the scope of the present invention.

Now referring to FIGS. 2 and 5, the reciprocating path 190 of the first and second swing members 149*a*/149*b* has a rear end 192, a front end 194, and a middle point 196. The middle point 196 is substantially the middle point between the rear end 192 and the front end 194. As shown in FIG. 2, the second end portion 154 of the second support member 120*b* is being at the rear end 192 of the reciprocating path 190 while the first end portion 153 of the second supporting member 120*b* is being approximately at the rearmost position during rotating about the first axis 134. As also shown in FIG. 5, the second end portion 154 of the second support member 120*b* is being at the front end 194 of the reciprocating path 190 while the first end portion 153 of the second supporting member 120*b* is being approximately at the foremost position during rotating about the rotating axis 134. In the preferred embodiment of the present invention, the reciprocating path 190 is substantially arcuate because of the swing motion of the first and second swing members 149*a*/149*b*, but the present invention is not limited to an arcuate reciprocating path. It should be noticed that relative positions between the swing axis 159 and the reciprocating path 190 can cause different exercise intensity of the stationary exercise apparatus 100.

More specifically, the positions of the swing axis 159 can determine incline levels of both the reciprocating path 190 and the second closed path 198. If the swing axis 159 is substantially vertically above the middle point 196 of the reciprocating path 190, the incline level of both the reciprocating path 190 and the second closed path 198 are substantially horizontal. If the swing axis 159 is positioned rearward in view of an orientation of an operating user, the incline levels of both the reciprocating path 190 and the second closed path 198 are increased. A higher incline level of the second closed path 198 creates higher exercise intensity of a user. As shown in FIG. 2, the swing axis 159 is positioned slightly in back of the middle point 196 of the reciprocating path 190 so that the second closed path 198 is slightly inclined and the exercise intensity is enhanced. In order to obtain higher exercise intensity, the swing axis 159 can be re-positioned farther toward the rear. As shown in FIG. 6, the swing axis 159 is in back of the rear end 192 of the reciprocating path 190 and both the reciprocating path 190 and the second closed path 198 are in a relatively high incline level so that the exercise intensity of the stationary exercise apparatus 100 is further increased.

In a preferred embodiment of the present invention, the adjusting assembly 145 can be controlled via the console 199 to vary the incline level of the second closed path 198 and to adjust the exercise intensity of the stationary exercise apparatus 100. As mentioned previously, the upper portions 150 of the first and second swing members 149*a*/149*b* are coupled to the moving assembly 141 of the frame 110. The adjusting assembly 145 is connected between the lateral link 143 (FIG. 5) of the moving assembly 141 and the frame 110. Therefore, a user can electronically actuate the adjusting assembly 145 to vary the position of the swing axis 159 and adjust the incline level of the second closed path 198. It should be noted that the (lateral) link 143 could be omitted in some embodiments, not shown in the figures. For example, two adjusting assemblies 145 are directly connected to the first and second moving members 142 respectively. The benefit of omitting the (lateral) link 143 is that the height of the first and second pedal 150*a*/150*b* could be lower because of less interference between the (lateral) link 143 and the second end portions of the first and second supporting members 120*a*/120*b*. A user may feel more comfortable in a lower operating position. It should also be noticed that the incline level of the stationary exercise apparatus 100 is not limited to an electronically adjustment. Some manual adjustments, such as pin and holes combinations, levers, cranks and the like are also within the scope of the present invention.

FIG. 5 shows the swing axis 159 is positioned to the rear of the middle point 196 of the reciprocating path 190 and the second closed path 198 is in a low incline level. FIG. 6 shows the swing axis 159 is positioned to the rear of the rear end 192 of the reciprocating path 190 and the second closed path 198 is in a higher incline level. In other embodiments of the present invention, the incline level of the second closed path 198 could also be non-adjustable. For example, the side portions 113 of the frame 110 extend upwardly and the first and second swing members 149*a*/149*b* are directly pivoted to the side portions 113 of the frame 110. In the non-adjustable embodiments, when the swing axis 159 is positioned slightly in back of the middle point 196, the second closed path 198 is in the low incline level, not flat, such as shown in FIG. 5. When the swing axis 159 is positioned in back of the rear end 192 of the reciprocating path 190, the second closed path 198 would be in the high incline level as shown in FIG. 6. Both the low and high incline level of the stationary exercise apparatus 100 can enhance exercise intensity of a user, comparing to a more horizontal incline level.

To operate the stationary exercise apparatus 100, a user respectively steps on the first and second pedals 150*a*/150*b* and grabs on the fixed handle assembly 180 or a pair of moving handles 172*a*/172*b*. The first end portions 153 of the first and second supporting members 120*a*/120*b* rotate along a substantially arcuate path about the first axis 134 and the second ends of the first and second supporting members 120*a*/120*b* move along the reciprocating path 190. Therefore, rear end portions of the first and second pedals 150*a*/150*b* move along the second closed path 198. As mentioned previously, the positions of the swing axis 159 are relative to some geometry parameters of the second closed path 198 and have great effects on the exercise intensity of a user of the stationary exercise apparatus 100.

Figure 8:
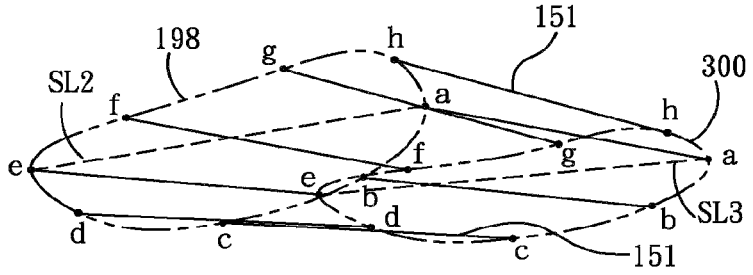
FIG. 8 are toe and heel path profiles of the stationary exercise apparatus of FIG. 1 in a relatively low incline condition.
Figure 9:
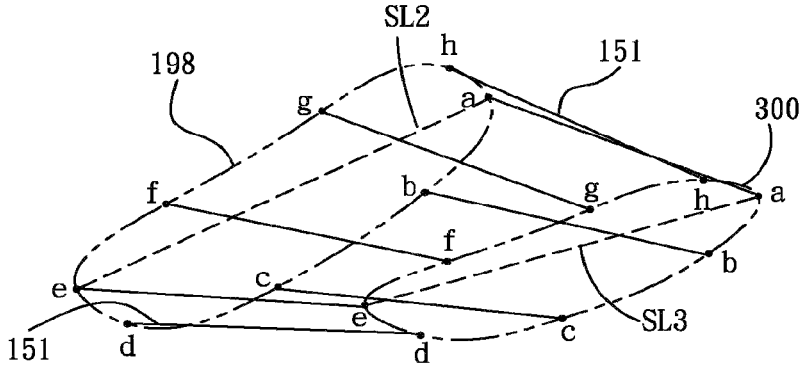
FIG. 9 are toe and heel path profiles of the stationary exercise apparatus of FIG. 1 in a relatively high incline condition.
Figure 10:
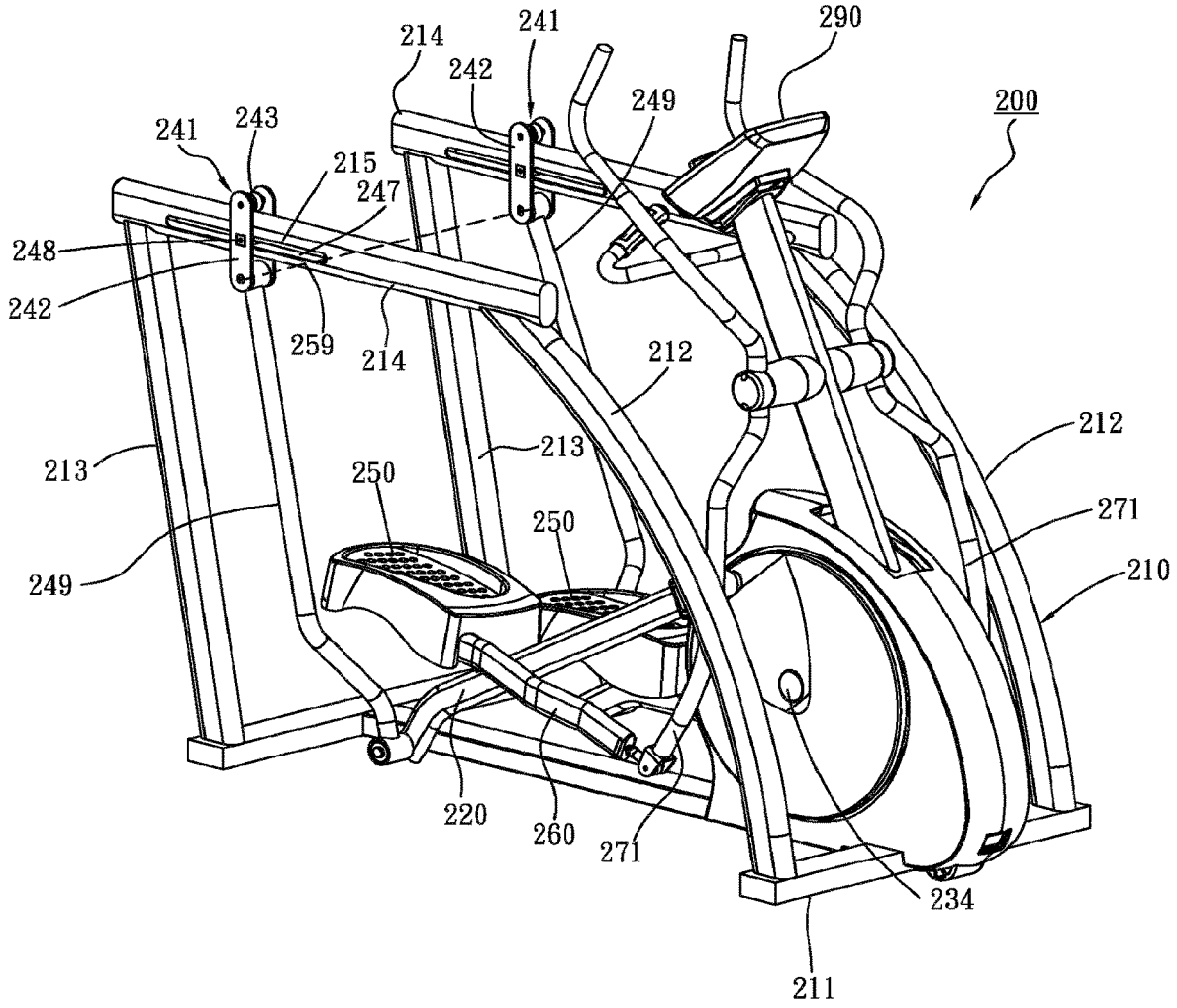
FIG. 10 is a perspective view of a stationary exercise apparatus according to another embodiment of the present invention.
Figure 11:
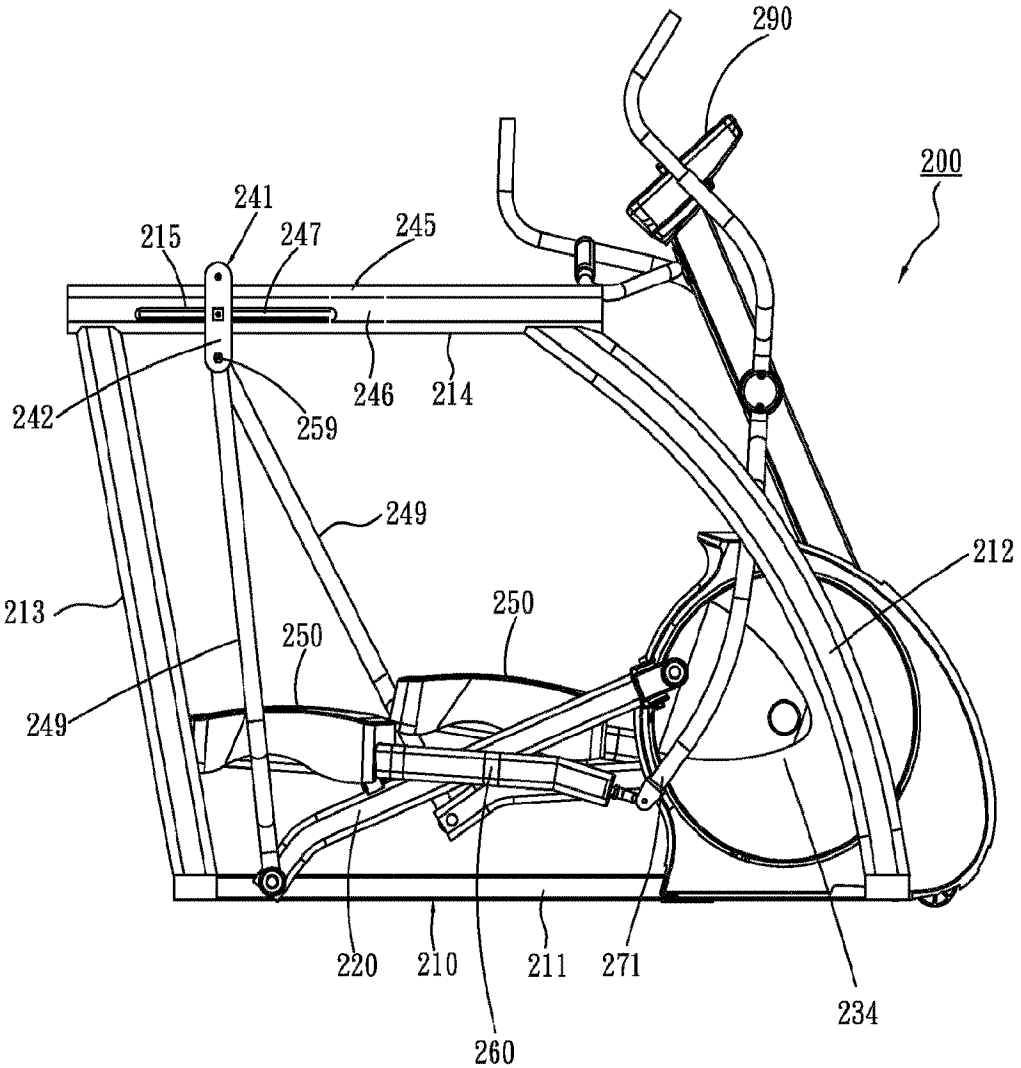
FIG. 11 is a side view of the stationary exercise apparatus of FIG. 10.
Figure 12:
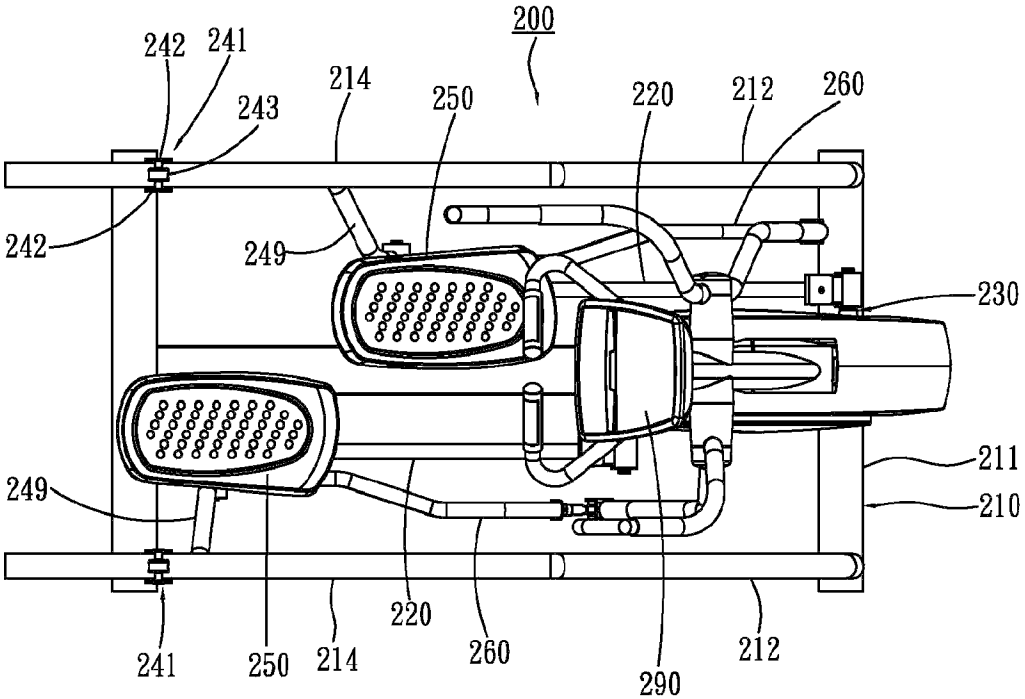
FIG. 12 is a top view of the stationary exercise apparatus of FIG. 10.

To better present the relationship between the swing axis 159 and the second closed path 198, separated path information is illustrated in FIGS. 8 and 9. FIG. 8 shows the path information and geometry parameters while the swing axis 159 is slightly in back of the middle point 196 as shown in FIG. 5. FIG. 9 shows the path information and geometry parameters while the swing axis 159 is to the rear of the rear end 192.

Now referring to FIG. 8 in more detail, the second closed path 198 is represented by eight correspondent points, a~h. The correspondent points a and e are the foremost and rearmost positions of the first ends of the first and second supporting members 120*a*/120*b* during rotating about the first axis 134. Each point is separated in an equal angle of forty-five degrees relative to the angle of rotation about the first axis 134. A stride length SL2 constituted by the correspondent points a and e is also one of the geometry parameters of the second closed path 198, in addition to the incline level. The stride length SL2 is substantially the stride length of the heel portion of a user because the second closed path 198 is the moving path of the rear ends of the pedals 150*a*/150*b* and the heel portion of a user is approximate to the rear ends of the pedals 150*a*/150*b*. Stride length is also relative to exercise intensity. A longer stride length generally results in higher exercise intensity. A third closed path 197 is the moving path of the front ends of the pedals 150*a*/150*b*. A stride length SL3 may also substantially represent the stride length of the toe portion of a user. Because the closed paths 198 and 197 are moving paths of the rear and front ends of the pedals 150*a*/150*b*, the orientation of the pedals 150*a*/150*b* can be illustrated by a pedal orientation 151 as shown in FIG. 8. One important character of the pedal orientation 151 is that the steepness of the pedal orientation 151 is increased when the swing axis 159 is adjusted backwardly.

Figure 7:
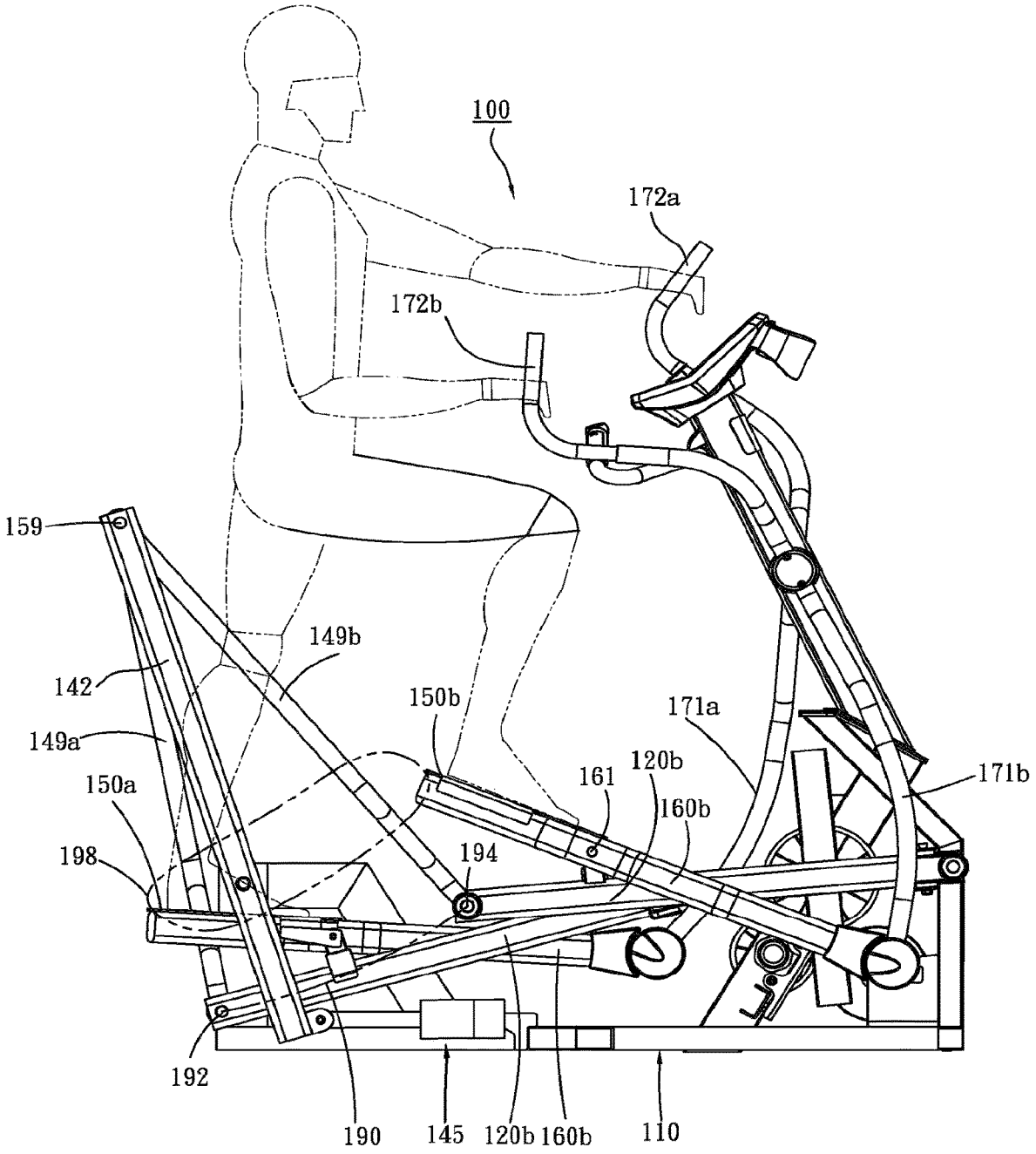
FIG. 7 is a side view of the stationary exercise apparatus of FIG. 1 in another rotating position of the high incline condition demonstrating better gluteus exercise of a user.

Now referring to FIGS. 7 and 9 show the stride length SL2, stride length SL3, pedal orientation 151, second closed path 198, and third closed path 197 while the swing axis 159 is in back of the rear end 192 of the arcuate path 190. As shown in FIG. 7, the first and second control links 160*a*/160*b* are respectively pivoted to the first and second supporting members 120*a*/120*b* via pivot axes 161. The incline level of the second closed path 198 of FIG. 9 is increased by 17 degrees compared to the incline level of FIG. 8, but the incline level of the third closed path 197 of FIG. 9 is only increased by 11 degrees. That is, the incline level of the second closed path 198 is increased more than the incline level of the third closed path 197 while the swing axis 159 is being adjusted backwardly. The stride length SL2 of FIG. 9 is increased by about 15 percent compared to the stride length SL2 as shown in FIG. 8, but the stride length SL3 of FIG. 9 is only increased by about 6 percent. That is, the stride length SL2 is increased more than the stride length SL3 while the swing axis 159 is being adjusted backwardly. Because both path inclination and stride length of the heel portion of a user are increased more than the toe portion, the exercise intensity of the heel portion is higher than the exercise intensity of the toe portion of a user which may also imply a higher exercise intensity of the gluteus of a user. Because the heel portion of the user is obviously elevated as shown in FIG. 7, the thigh of the user is elevated to a substantially horizontal orientation relative to the ground surface so that the gluteus of the user is fully exercised.

Now referring to FIGS. 10 through 13, a second preferred embodiment of the present invention is shown. A stationary exercise apparatus 200 comprises a frame 210 having a base portion 211 adapted to rest on a surface. The frame 210 further comprises a front portion 212 extending upwardly from the base portion 211, a side portion 214 extending longitudinally rearward from the front portion 212, and a rear portion 213 connecting the side portion 214 and the base portion 211.

The stationary exercise apparatus 200 further has first and second supporting members 220, each of the supporting members 220 having a first end portion and a second end portion. The first end portions of the first and second supporting members 220 are respectively pivoted to a pair of rotating members 233 in order to rotate about a first axis 234. The second end portions of the first and second supporting members 220 are respectively connected to the lower portions of first and second swing members 249. The upper portions of the first and second swing members 249 are coupled to the side portion 214 of the frame 210 via a swing axis 259. More specifically, the upper portions of the first and second swing members 249 are pivotally connected to left and right moving assemblies 241.

Each of the left and right moving assemblies 241 respectively comprises third and fourth moving members 242. Each of the third and fourth moving members 242 is connected to left and right adjusting assemblies 245 (FIG. 11) so that the moving assemblies 241 could be driven by the adjusting assemblies 245. Each of the left and right moving assemblies 241 further includes an optional roller 243. The rollers 243 are respectively engaged on the side portion 214 for increasing stability and smoothness of movement of the moving assemblies 241 along the side portion 214.

Figure 13:
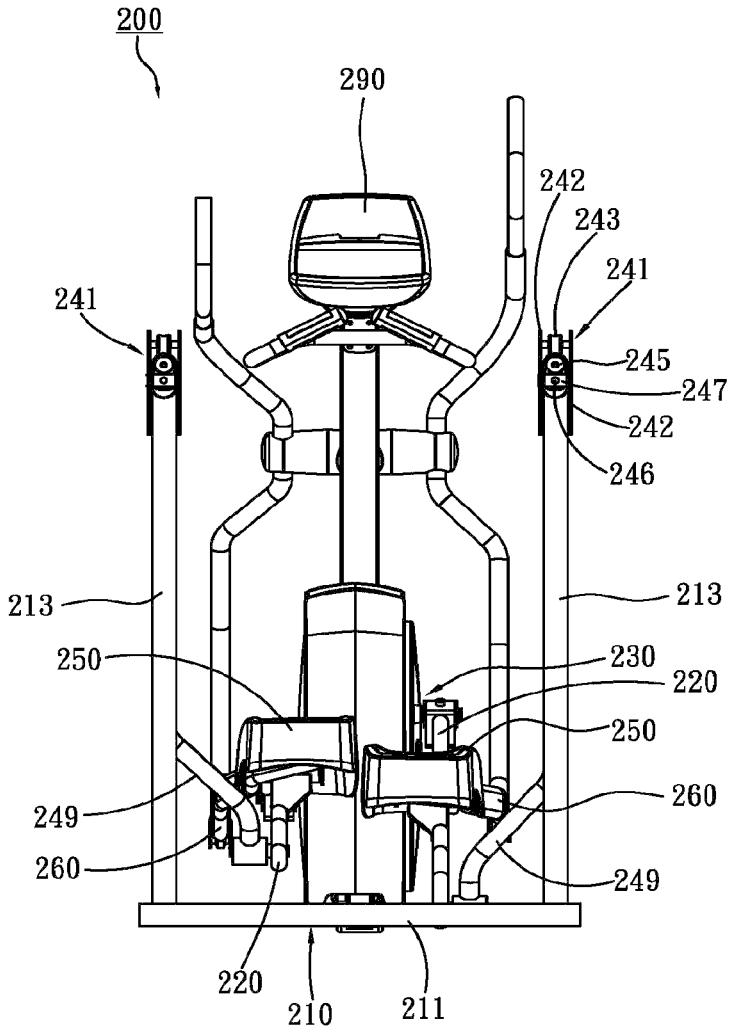
FIG. 13 is a back view of the stationary exercise apparatus of FIG. 10.

As illustrated in FIG. 13, each of the adjusting assemblies 245 includes a motor 246 mounted on one portion of the frame 210, a screw rod 247, and a screw member 248. The screw rod 247 has one end connected to the motor 246 and a portion adapted for movement of the screw member 248. Although described and illustrated as a screw adjusting mechanism, the adjusting assembly 245 could be any manual or automatic mechanical, electromechanical, hydraulic, or pneumatic device and be within the scope of the invention.

In the second preferred embodiment of the present invention, the upper portions of the first and second swing members 249 are respectively pivoted to the third and fourth moving members 242. But, the upper portions of the first and second swing members 249 can also be directly pivoted to the screw members 248 of the adjusting assemblies 245. Therefore, actuating of the motor 246 can cause rotation of the screw rod 247 to change the positions of both the third and fourth moving member 242 and the swing axis 259.

Similar to the previous preferred embodiment of the stationary exercise apparatus 100, the stationary exercise apparatus 200 also comprises a pair of pedals 250 respectively coupled to the supporting members 220. Optionally, the stationary exercise apparatus 200 also has a pair of control links 260 respectively pivoted to the supporting members 220 and a pair of handle links 271 coupled to the frame 210 for guiding the control links 260.

Figure 14:
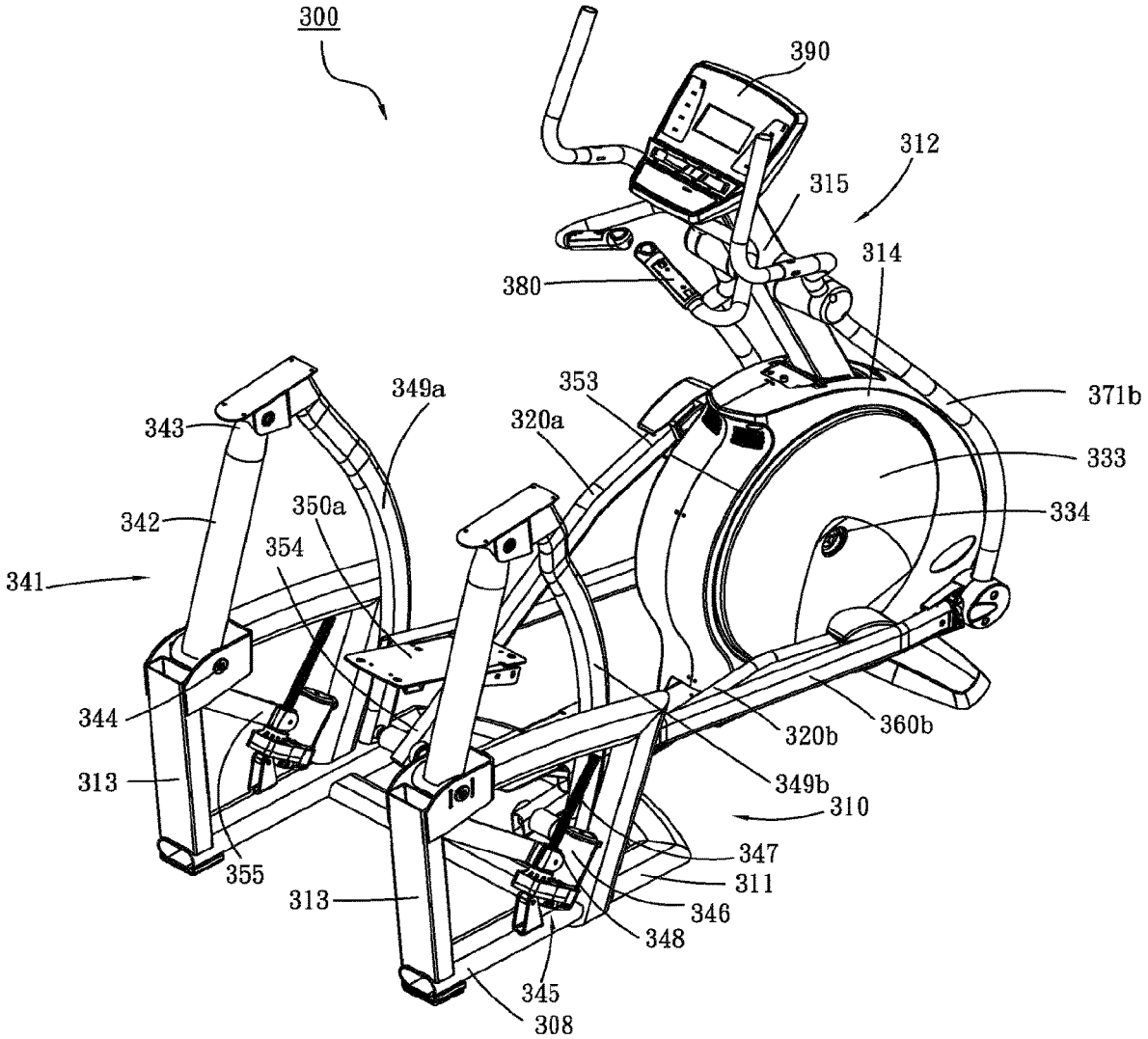
FIG. 14 is a perspective view of a third embodiment of a stationary exercise device in accordance with the present invention.
Figure 15:
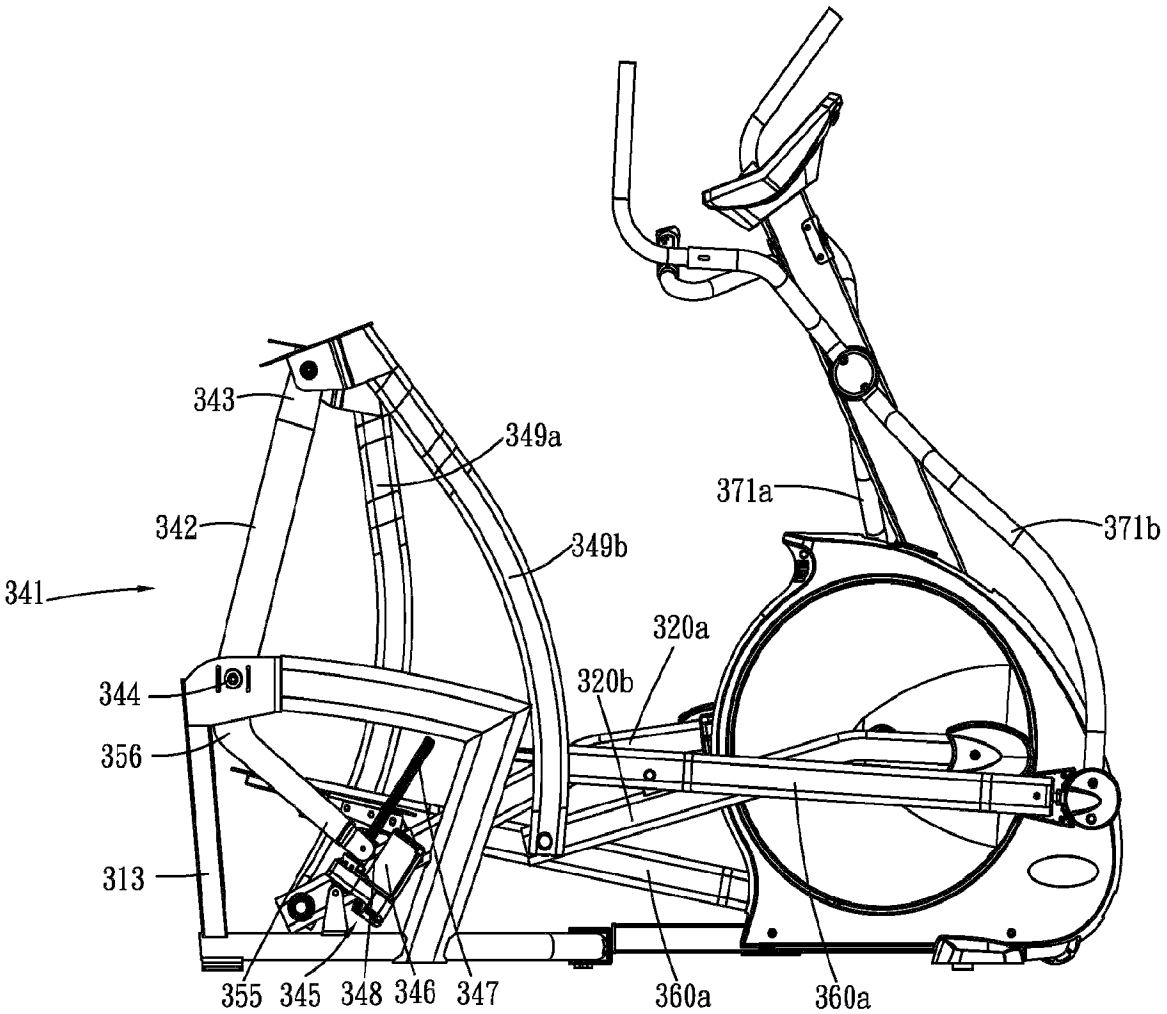
FIG. 15 is a side view of the stationary exercise apparatus of FIG. 14.
Figure 16:
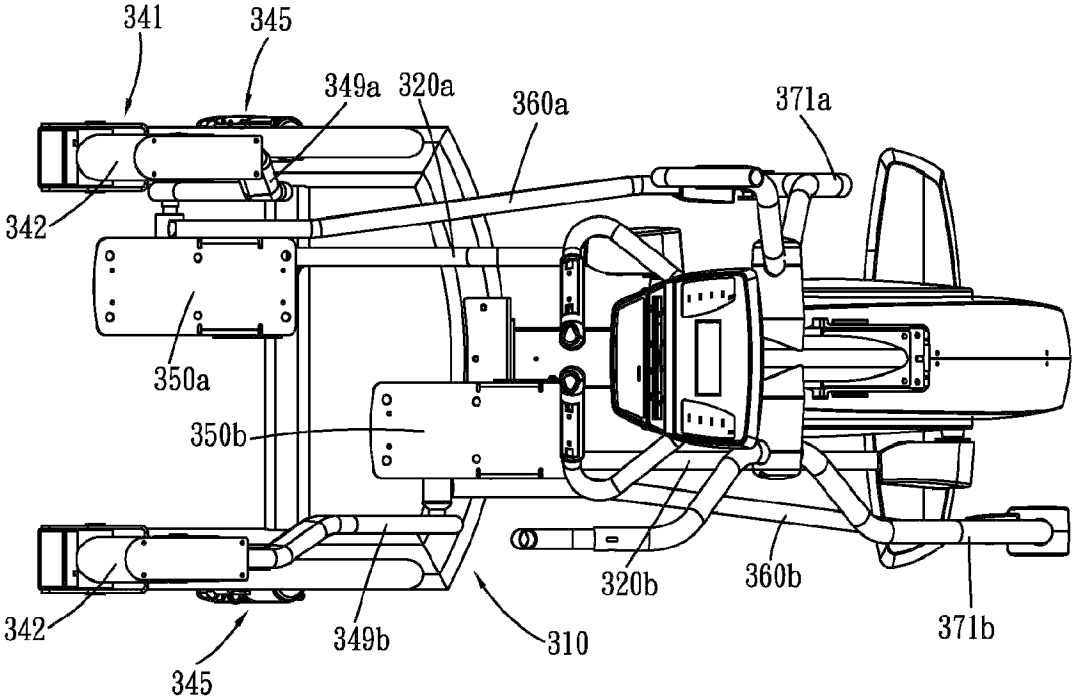
FIG. 16 is a top view of the stationary exercise apparatus of FIG. 14.

FIGS. 14 through 16 illustrate an embodiment similar to the embodiment illustrated in FIGS. 1 through 9. This third embodiment of a stationary exercise apparatus 300 includes a frame 310 having a base 311, a front portion 312, a rear portion 308, and side portions 313. The frame 310 may also include a post 314 and a standard 315. A handle assembly 380 and a console 390 are also provided as described above in relation to the first and second embodiments.

The third embodiment of the exercise apparatus 300 includes rotating members 333 that rotate about a first axis 334, similar to those described and illustrated in relation to the second embodiment 200 (FIGS. 10 through 13). An optional resistance member is also provided.

Similar to the embodiment illustrated in FIGS. 1 to 9, the third embodiment of the exercise apparatus 300 also includes first and second supporting members 320*a*/320*b*, each having a first end portion 353 rotatably joined to the rotating members 333 and a second end portion 354. The second end portions 354 are respectively joined to swing members 349*a*/349*b*. The swing members 349*a*/349*b* are joined to the frame side portions 313 in a manner substantially similar to that described above in relation to the first embodiment 100.

There is also provided a moving assembly 341 including first and second moving member 342 that are defined by an upper portion 343 and a lower portion 355 joined at an elbow 356, so that the upper portion 343 and the lower portion 355 are at an angle to one another as illustrated. The first and second moving members 342 are joined to the side portions 313 via a second axis 344 to pivot as described above.

An optional adjusting assembly 345 is provided on each side of this embodiment. The adjusting assembly 345 activates the moving assembly 341 about the second axis 344. The adjusting assembly includes a motor 346, a screw rod 347, and a threaded nut, sleeve, or tube 348. The motor 346 is connected to the base 311 and to the screw rod 347. In this embodiment, the screw rod 347 is generally upright and angled slightly forward. The screw rod 347 is threaded through the tube 348, which is pivotally mounted on the lower portion 355 of the moving members 342. In this manner, the motor 346 can be activated automatically or manually from the console 390 to rotate the screw rod 347, which in turn raises or lowers the tube 348 along the screw rod 347. As the tube 348 is raised or lowered, the moving member 342 pivots about the second axis 344. A manually operated adjusting assembly could also be used, as described above.

In this embodiment of the exercise apparatus 300, the swing members 349*a*/349*b* are illustrated as arcuate in shape so that the support members 320*a*/320*b* need not extend rearwardly as far as those illustrated in previous embodiments. Otherwise, the operation of the swing member 349*a*/349*b* and the support members 320*a*/320*b* are essentially as described above.

First and second pedals 350*a*/350*b* are respectfully coupled to the first and second supporting members 320*a*/320*b*, either directly or indirectly. To couple the pedals 350*a*/350*b* indirectly to the support members 320*a*/320*b*, there are provided first and second control links 360*a*/360*b* which are pivotally connected to the support members 320*a*/320*b*. The pedals 350*a*/350*b* are joined to the control links 360*a*/360*b* and move in a second closed path when the support members 320*a*/320*b* move as described above.

Handle links 371*a*/371*b* are illustrated for this embodiment, and as with the above embodiments, may be substituted by tracks, rollers, sliders, and the like to provide support for the moving first end portions of the control links 360*a*/360*b*. Any such device is referred to herein as a "handle link" regardless of whether it actually serves as a handle for a user.

Figure 20:
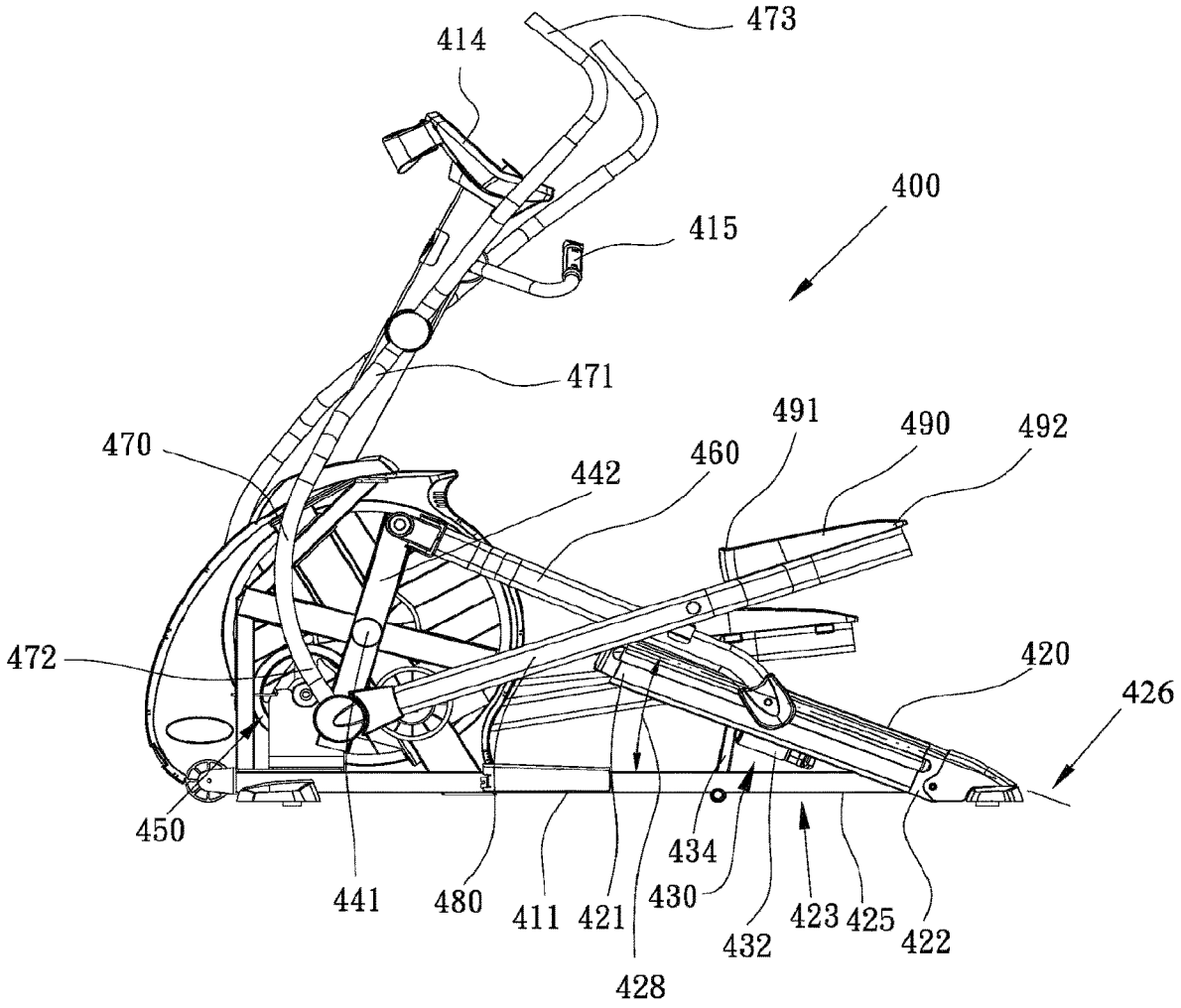
FIG. 20 is a left side view of the stationary exercise apparatus of FIG. 17 in a relatively high incline condition.
Figure 21:
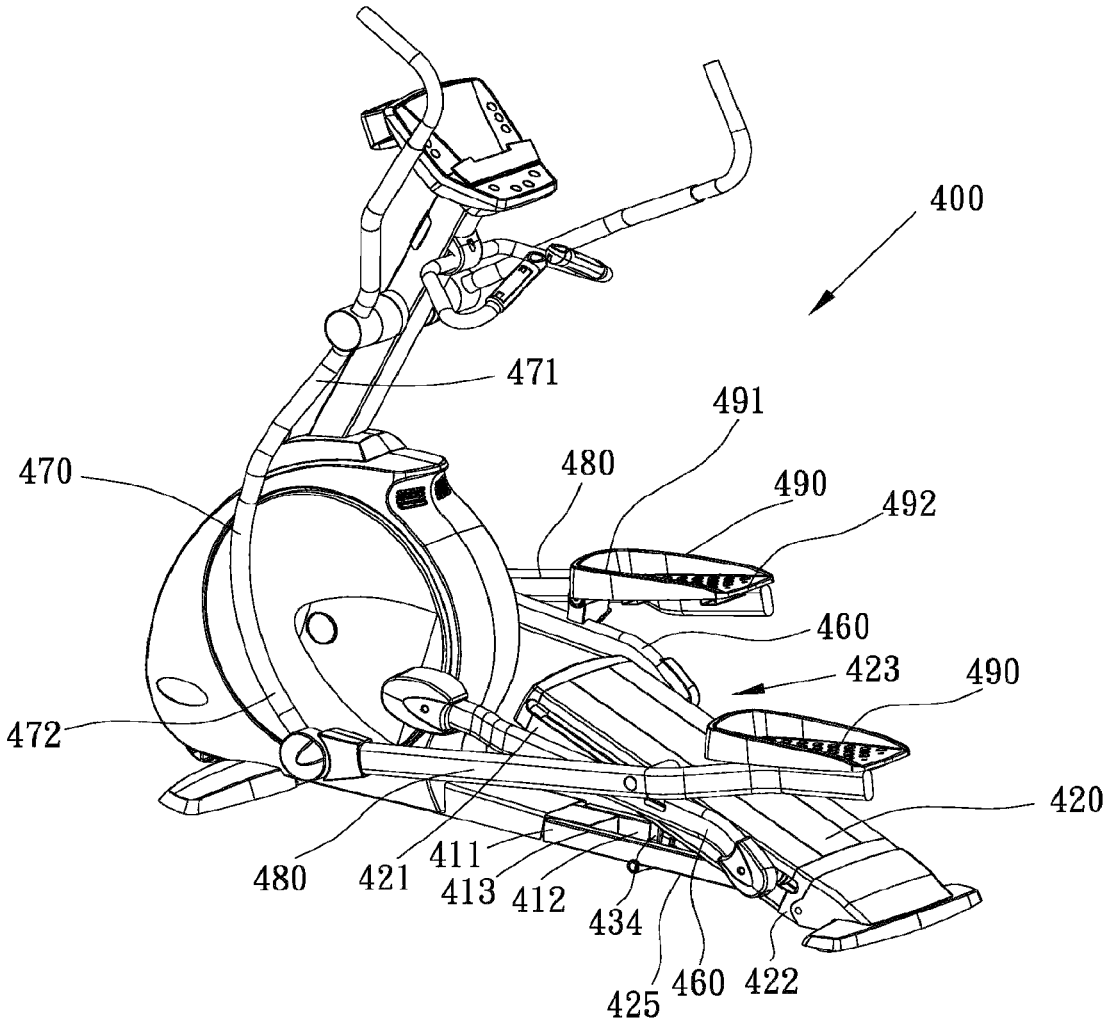
FIG. 21 is a left side perspective view of the stationary exercise apparatus of FIG. 17 in a relatively high incline condition.

FIGS. 17 through 21 illustrate an embodiment having substantial portion similar to the embodiments illustrated in FIGS. 1 through 16. This fourth embodiment of a stationary exercise apparatus 400 includes a frame 410 having a base and a rear portion 425 (FIG. 20). The frame 410 may also include a front portion having a post 412 and a standard 413. A fixed handle assembly 415 and a console 414 are also provided as described above in relation to the previous embodiments.

The fourth embodiment of the exercise apparatus 400 includes rotating members 418 that rotate about a first axis 441, similar to those described and illustrated in relation to the second embodiment 200 (FIGS. 10 through 13). An optional resistance assembly 450 is also provided.

Similar to the embodiment illustrated in FIGS. 1 to 9, the fourth embodiment of the exercise apparatus 400 also includes first and second supporting members 460, each having a first end portion 461 rotatably joined to the rotating members 418 and a second end portion 463. Preferably, the second end portion is coupled with some rollers or sliders for reciprocating movement on a surface such as a track surface. The second end portions 463 of the first and second supporting members 460 are respectively reciprocated on a guider assembly 423 which is coupled to the rear portion 425 of the base 411. There is more detail description of the guider assembly 423 hereinafter.

Figure 22:
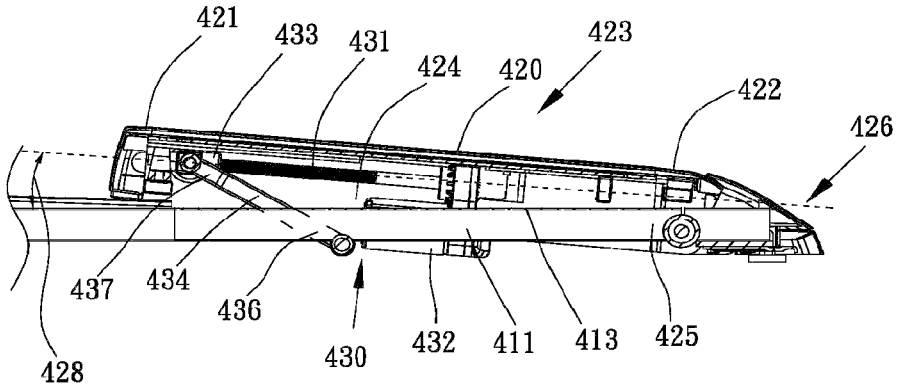
FIG. 22 is a left side view of the guide assembly of the stationary exercise apparatus of FIG. 17 in a relatively low incline condition.
Figure 23:
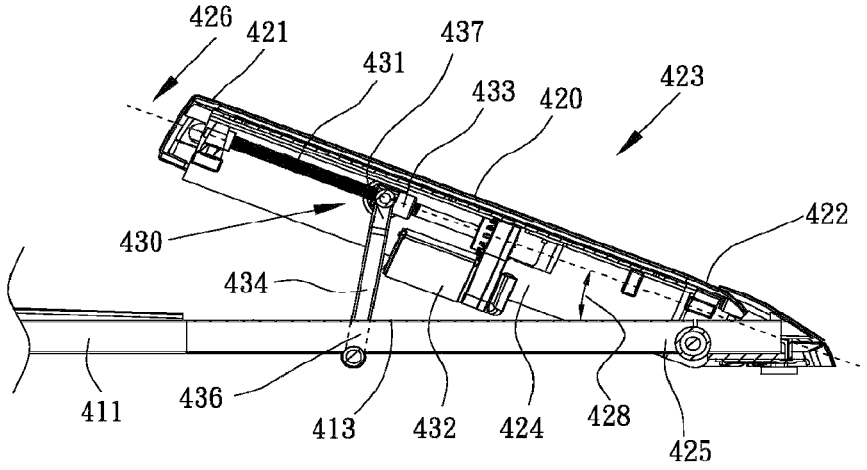
FIG. 23 is a left side view of the guide assembly of the stationary exercise apparatus of FIG. 17 in a relatively high incline condition.

Now referring to FIGS. 22 and 23, the guider assembly 423 comprises a guider 420 coupled to the rear portion 425 of the base 411 and a moving member 434 movably coupled between the guider 420 and the base 411. The guider 420 has a first end portion 421, and a second end portion 422 pivotally connected to the base 411. A reciprocating path 426 is defined between the first and second end portions 421/422 of the guider 420. In the embodiment illustrated in FIGS. 17 through 21, the guider 420 is a linear track to define the reciprocating path 426 substantially parallel to the surface of the guider 420. In other embodiments, the guider 420 could be a curved track (not shown), the reciprocating path 426 is a virtual linear line connecting first and second ends of the curved track. An incline angle 428 is defined by the reciprocating path 426 and the base 411 in both linear and curved track embodiments. More specifically, the incline angle 428 is defined by the reciprocating path 426 and the top horizontal surface of the base 411, or a ground surface on which the base 411 rests.

Figure 24:
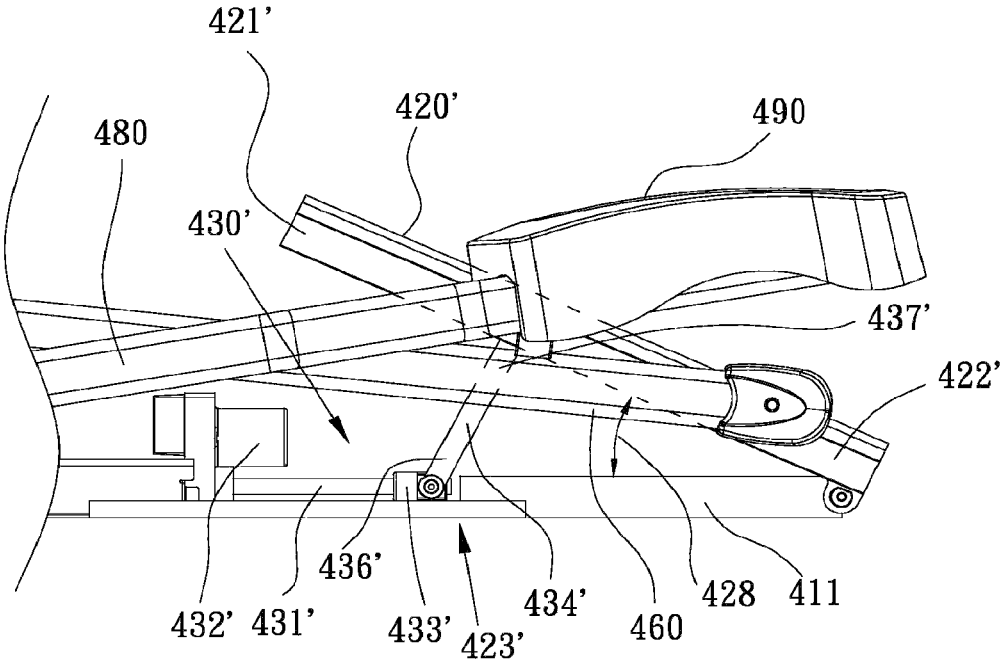
FIG. 24 is a left side view of an alternative embodiment of the guide assembly of the stationary exercise apparatus of FIG. 17 in a relatively high incline condition.

FIGS. 22 through 24 illustrate detailed views of the guider assembly 423 and an alternative embodiment of the guider assembly 423. In FIG. 22, the guider 420 is in a relatively low incline condition and the incline angle 428 defined by the guider 420 and the base 411 is about 5 degrees. The moving member 434 has a first end portion 436 pivotally connected to the base 411, and a second end portion 437 movably coupled to the guider 420. In FIG. 23, the second end portion 437 of the moving member 434 is selectively coupled to the guider 420 close to a middle position between the first and second end portions 421/422 of the guider 420. In the arrangement of FIG. 23, the moving member 434 is inclined further upwardly, and the incline angle 428 is increased to about 22 degrees. The exercise apparatus 400 is in a relatively high incline condition when the incline angle 428 is about 22 degrees.

An optional adjusting assembly 430 is provided under the guider 420 in the embodiment shown in FIGS. 22 and 23. The adjusting assembly 430 activates the moving member 434 electronically to vary the incline angle 428. The adjusting assembly 430 includes a motor 432, a screw rod 431, and a threaded nut, sleeve, or tube 433. The motor 432 is connected to the screw rod 431 for driving the screw rod 431. In this embodiment, the screw rod 431 is mounted under the guider 420 in an orientation generally parallel to the reciprocating path 426. The screw rod 431 is threaded through the tube 433, which is pivotally mounted on the second end portion 437 of the moving member 434. In this manner, the motor 432 can be activated automatically or manually from the console 414 to rotate the screw rod 431, which in turn pushes or pulls the tube 433 along the screw rod 431. As the tube 433 is pushed or pulled, the second end portion 437 of the moving member 434 is movably coupled between the guider 420 and the base 411. A manually operated adjusting assembly could also be used, as described above.

The guider assembly 423' shown in FIG. 24 is an alternative embodiment of the guider assembly 423 shown in FIGS. 22 and 23. The guider assembly 423' also includes a guider 420' coupled to the base 411, and a moving member 434' having a first end portion 436' movably coupled to the base 411, and a second end portion 437' pivotally connected to the guider 420'. In FIG. 24, the first end portion 436' of the moving member 434' is selectively coupled to the base 411 and the second end portion 437' is pivotally connected to the guider 420' closed to a middle position of the guider 420'. The middle position is between first second end portions 421'/422' of the guider 420'. There is also an optional adjusting assembly 430' mounted on the base 411. Similar to what is described previously; the adjusting assembly 430' can also activate the moving member 434' to vary the incline angle 428.

There are also other alternative embodiments of the guider assembly 423' shown in FIG. 24. For example, the screw rod 431' could be replaced by a bracket mounting on the base 411 with several receiving notches positioned substantially horizontally. Then, the first end portion 436' of the moving member 434' could selectively be coupled to one of the receiving notches by manual operation of a user in order to vary the incline angle 428. Another example is that the moving member 434' comprises a pair of telescopic tubes which can be contracted or expanded to each other when the incline angle 428 is decreased or increased. In the embodiment of the telescopic tubes, both first and second end portions 436'/437' of the moving member 434' are pivotally connected to the base 411 and the guider 420'. The telescopic tubes could be selectively locked to each other for different incline angles of the guider 420'.

In addition to the benefits described in the previous embodiments shown in FIGS. 1 through 16, the embodiments shown in FIGS. 17 through 24 further have the following advantages. Substantial portions of both the moving member 434 and adjusting assembly 430 could be hidden by the base 411 and the guider assembly 423 which further comprises a shroud 424 (FIG. 23) when the incline angle 428 is in the condition of FIG. 19 or 22, the relative low incline condition. Therefore, appearance of the stationary exercise apparatus 400 is more compact and succinct in the relative low incline condition. Further, the positioning of the adjusting assembly 430 under the guider 420 permits a more compact appearance, while allowing for efficient transfer of mechanical force from the adjusting assembly 430 to the guider 420. Also, in a preferred embodiment, the base 411 can include an access hatch 412 to permit ready access to the adjusting assembly 430 and the guider 420. The access hatch 412 is located below the top surface 413 of the base 411 in order to access or hide some portion of the adjusting assembly 430 and the moving member 434 when the guider 420 is at the lowest incline condition as shown in FIG. 22.

Figure 17:
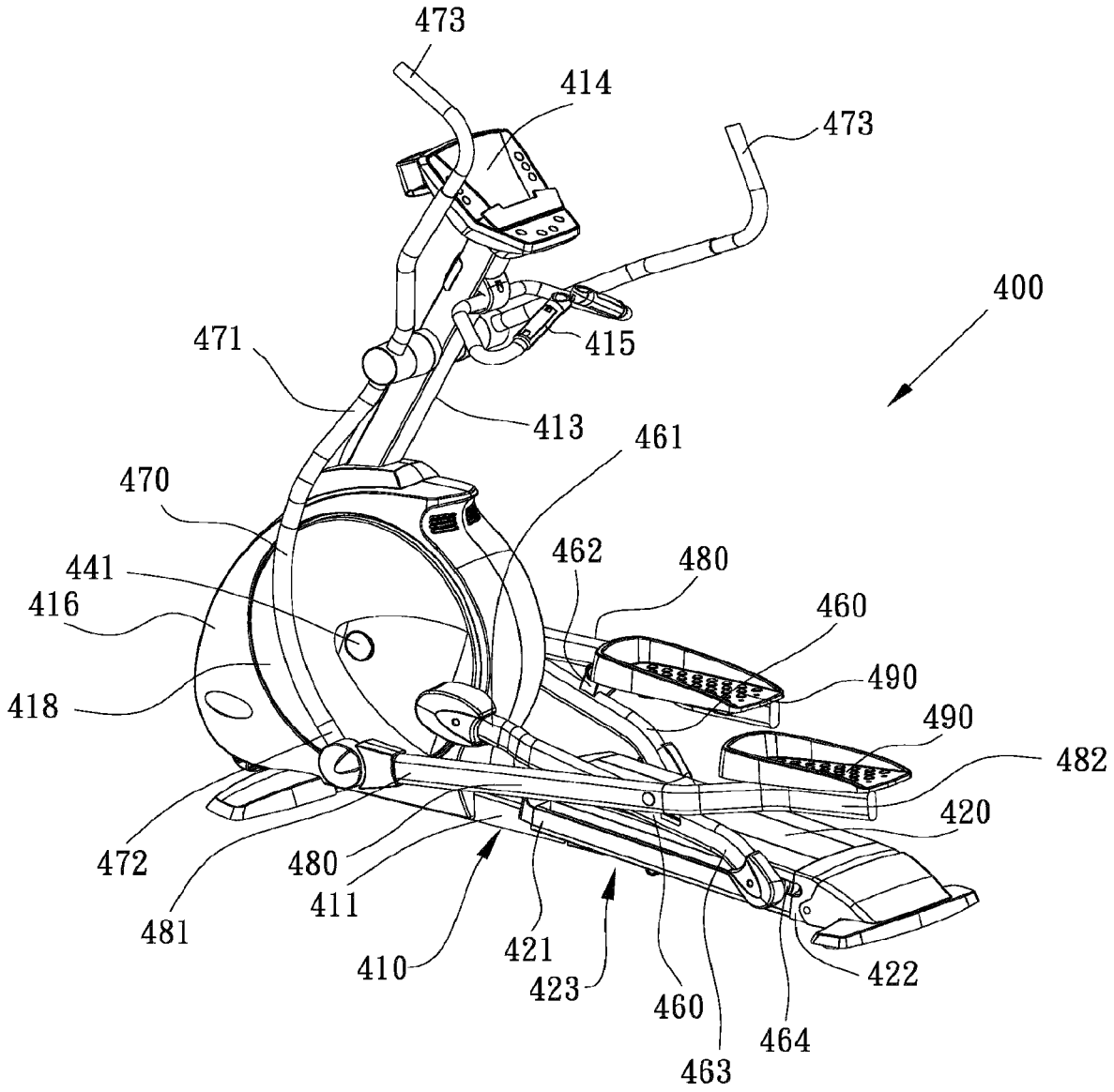
FIG. 17 is a left side perspective view of a fourth embodiment of a stationary exercise device in accordance with the present invention.
Figure 18:
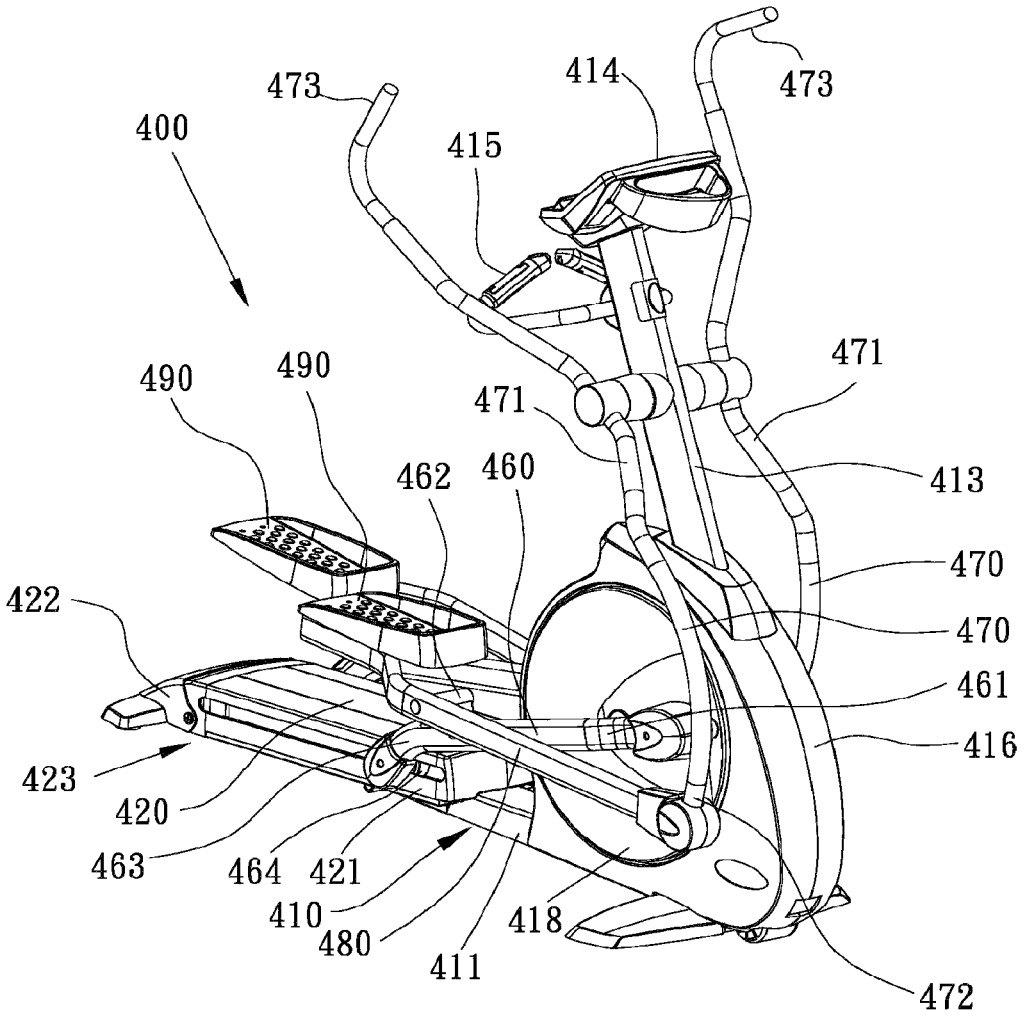
FIG. 18 is a right side perspective view of the stationary exercise apparatus of FIG. 17.
Figure 19:
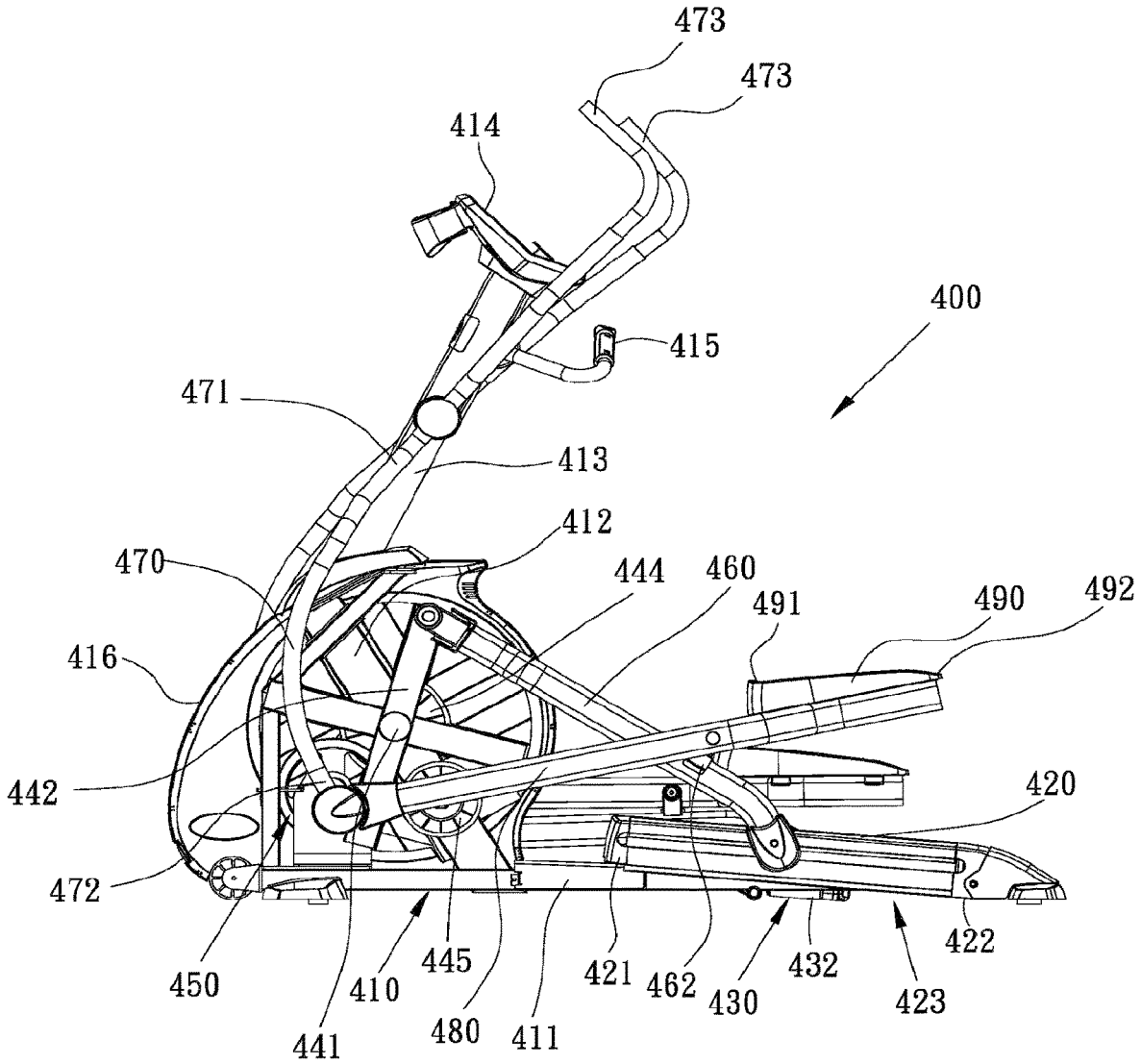
FIG. 19 is a left side view of the stationary exercise apparatus of FIG. 17 in a relatively low incline condition.

Now referring to FIGS. 17 and 20, first and second pedals 490 are respectively coupled to the first and second supporting members 460, either directly or indirectly as described above. Each of the pedals 490 respectively has a front end portion 491 and a rear end portion 492. To couple the pedals 490 indirectly to the support members 460, there are provided first and second control links 480 which are pivotally connected to the supporting members 460. The pedals 490 are joined to the control links 480 and move in a second closed loop path 498 and a third closed loop path 497 when the supporting members 460 move as described above.

Handle links 470 are illustrated for this embodiment, and as with the above embodiments, may be substituted by tracks, rollers, sliders, and the like to provide support for the moving first end portions 481 of the control links 480. Any such device is referred to herein as a "handle link" regardless of whether it actually serves as a handle for a user.

Figure 25:
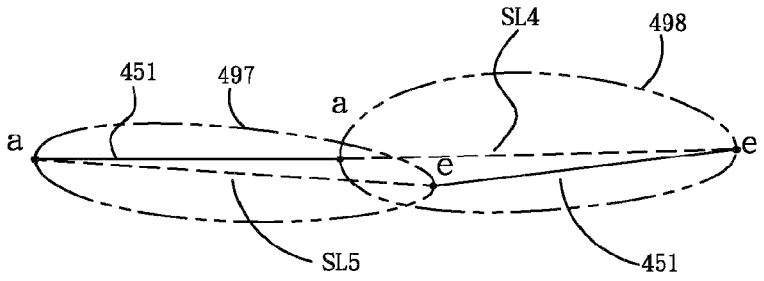
FIG. 25 shows toe and heel path profiles of the stationary exercise apparatus of FIG. 17 in a relatively low incline condition.
Figure 26:
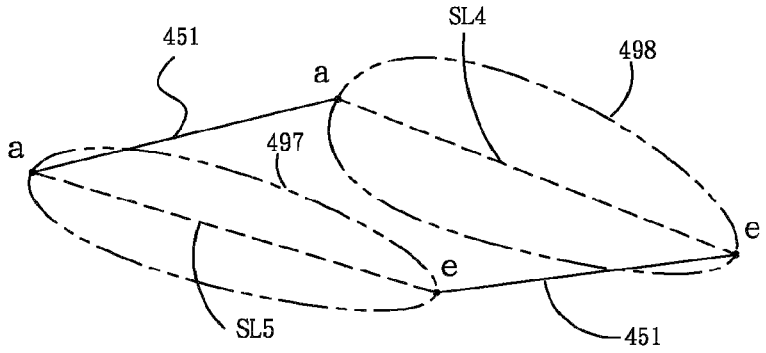
FIG. 26 shows toe and heel path profiles of the stationary exercise apparatus of FIG. 17 in a relatively high incline condition.

FIGS. 25 and 26 are path profiles and information of the stationary exercise apparatus 400 when the guider 420 is in the relatively low and high incline conditions. The points a and e are also correspondent to the foremost and rearmost positions when the first ends of the first and second supporting members 460 are rotating about the first axis 441. Similar to described above, second and third closed loop paths 498/497 are respectively representing the moving paths of the heel and toe portions of a user of the stationary exercise apparatus 400; stride lengths SL4 and SL5 are respectively representing the stride lengths of the heel and toe portions of a user of the stationary exercise apparatus 400 similar to the description of FIG. 9.

Stride length is relative to exercise intensity and a longer stride length generally results in higher exercise intensity. In FIG. 25, the stride length SL4 is substantially same with the stride length SL5. But, comparing the stride length SL4 with the stride length SL5 in FIG. 26, the stride length SL4 is longer than the stride length SL5 when the stationary exercise apparatus 400 is in the relatively high incline condition. That is, the length of the stride length SL4 is greater than the length of the stride length SL5 when the guider 420 is adjusted from a relatively low incline condition to a relatively high incline condition. Therefore, the heel portion and gluteus portion of a user are having higher exercise intensity when the stationary exercise apparatus 400 is in the relatively high incline condition.

The orientation of the pedals 490 can be simply illustrated by a pedal orientation 451 as shown in FIGS. 25 and 26, a connection between the front and rear ends of the pedals 490. One important character of the pedal orientation 451, in the foremost position a, is that the steepness of the pedal orientation 451 is increased forwardly when the guider 420 is adjusted from the relatively low incline condition to the relative high incline condition. That is, in the foremost position a, the rear end portion 492 is moved upwardly at a faster rate than the front end portion 491 of the pedals 490 when the guider 420 is adjusted from the relatively low incline condition to the relative high incline condition. Simply speaking, in the foremost position a, the rear end portion 492 is moved higher than the front end portion 491 of the pedals 490 when the incline angle 428 is increased. Since the steepness, in the foremost position a, of the pedal orientation 451 is more obvious in the relatively high incline condition, the heel portion of a user is elevated more obvious than the toe portion of a user, therefore the gluteus of the user could be fully exercised as described above.

The previously described embodiments of the present invention have many advantages, including: (a) to provide a user of the stationary exercise apparatus with a benefit of high exercise intensity; (b) to provide a user of the stationary exercise apparatus with a benefit of an inclined foot path; (c) to provide a user of the stationary exercise apparatus with a benefit of an increased stride length; and (d) to provide a user of the stationary exercise apparatus with a benefit of better gluteus exercise; (e) to provide the stationary exercise apparatus with a more compact and succinct appearance. The present invention does not require that all the advantageous features and all the advantages need to be incorporated into every embodiment thereof. Although the present invention has been described in considerable detail with reference to certain preferred embodiment thereof, other embodiments are possible. Therefore, the spirit and scope of the appended claims should not be limited to the description of the preferred embodiment contained herein.

FIG. 27 through FIG. 30 show an exercise apparatus 500 in accordance with a fifth embodiment of the present invention. The exercise apparatus 500 comprises a frame 510 having a base 512 adapted to stably rest on a ground, and a support frame 514 extended upwardly from the front end of the base 512. A crank mechanism 520 is mounted on the support frame 510. The crank mechanism 520 has a crank shaft 522 and two cranks 524 (note: only one crank is shown in the figures). The crank shaft 522 is transversely and pivotally mounted to the support frame 514 at a predetermined height such that the crank shaft 522 can be rotated forward or backward in a fixed position about its own axis. The axis of the crank shaft 522 (hereinafter "first axis") defines a left-right direction axis of the exercise apparatus 500, that is, the opposite ends of the crank shaft 522 respectively correspond to the left-hand and right-hand side directions of a user when the exercise apparatus 500 is used. The two cranks 524 are respectively fixed to the left and right ends of the crank shaft 522. The two cranks 524 are perpendicular to the crank shaft 522, such that the two cranks 524 extend radially from the respective ends of the crank shaft 522 in opposite directions, namely, in the side view, the outer ends of the left and right cranks 524 are maintained at 180 degrees relative to the crank shaft 522.

A flywheel 530 is arranged below the crank mechanism 520. The flywheel 530 is pivotally mounted to the support frame 514 and it axle center is in accord with the left-right direction axis as well. The flywheel 530 and the crank shaft 522 are connected by a belt transmission mechanism 540. When the crank mechanism 520 is driven by an external force to rotate, the flywheel 530 rotates at a faster speed to provide an appropriate rotating load and movement of inertia, so that the rotation of the crank mechanism 520 would be more stable and smooth. Preferably, the exercise apparatus 500 may also be provided with a resistance device (not shown) cooperating with the flywheel 530 or connected to the crank mechanism 520, such as an eddy current brake, a generator brake, a friction brake, a water resistance device, a wind resistance device for generating a resistance which could be adjusted by a user, and thereby to set the force required for driving the crank mechanism 520, namely to set the difficulty level of the movement. However, the structure and operation of the resistance device are conventional techniques that are well known in the art, the detailed description is not mentioned in the present invention.

The exercise apparatus 500 has symmetrical left and right lower swing members 550 and left and right supporting members 560. Each lower swing member 550 has a first end and a second end, and the first end is generally arranged forward relative to the second end. The first end is pivotally connected to the front end of the base 512 at a second axis (not shown) in accord with the left-right direction axis, so that the second end of each lower swing member 550 is able to swing up and down with respect to the first end about the second axis. Each of the supporting members 560 is substantially a rod body having an upper end pivotally connected to the outer end of the crank 524 at the corresponding side and a lower end pivotally connected to the second end of the lower swing member 550 at the corresponding side, such that the upper ends of the supporting members 560 can be fully rotated by 360 degrees along with the outer ends of the cranks 524. Besides, when the upper ends of the supporting members 560 are revolved along a circular path CP guided by the respective cranks 524, the lower portions of the supporting members 560 are reciprocated between a first end point E1 and a second end point E2 of an arc reciprocating path RP1 guided by the lower swing members 550. Preferably, the first end point E1 of the reciprocating path RP1 is located higher than the second end point E2 of the reciprocating path RP1 and an acute included angle between a connection line of the first end point E1 and the second end point E2 and a horizontal plane (e.g. a ground) is greater than 45 degrees. In the preferred embodiment of the present invention, the position of the first end point E1 is more forward than the position of the second end point E2 of the reciprocating path RP1. Specifically, the elevation angle of the first end point E1 relative to the second end point E2 is about 60 degrees.

Furthermore, the reciprocating path RP1 is entirely located below a lowermost point of the circular path CP, and the reciprocating path RP1 is located closer to the rear than the center of the circle path CP (namely the axis of the crank shaft 522). When the lower end of each supporting member 560 is located at the first end point E1 of the reciprocating path RP1 closest to the circular path CP, the upper end of the supporting member 560 is correspondingly located at a first dead point D1 on a front upper quarter arc of the circular path CP. (Note: In a side view, the first dead point D1, the center of the circle path CP and the first end point E1 of the reciprocating path RP1 are aligned.) In contrast, when the lower end of each supporting member 560 is located at the second end point E2 of the reciprocating path RP1 farthest from the circular path CP, the upper end of the supporting member 560 is correspondingly located at a second dead point D2 on a rear lower quarter arc of the circular path CP. (Note: In a side view, the center of the circle path CP, the second dead point D2 and the second end point E2 of the reciprocating path are aligned.) Since the center of the circular path CP, the first end point E1 and the second end point E2 of the reciprocating path RP1 are not collinear in side view, the first dead point D1 and the second dead point D2 of the circular path CP are not exactly 180 degrees opposite to each other. Specifically, the upwardly extending line of the connection line between the first end point E1 and the second end point E2 of the reciprocating path RP1 is directly below the center of the circular path CP. The first dead point D1 is located at an elevation angle about 70 degrees relative to the center of the circular path CP. The second dead point D2 is located at a depression angle about 68 degrees relative to the center of the circular path CP. When the upper end and the lower end of the supporting member 560 at one side respectively located at the second dead point D2 and the second end point E2, since the outer ends of the left and right cranks 524 are 180 degrees opposite to each other, the upper end of the supporting member 560 at the other side is correspondingly located below and near the first dead point D1, and the lower end is correspondingly located below and near the first end point E1 of the reciprocating path RP1.

The upper end (or "first portion") and the lower end (or "second portion") of each supporting member 560 are respectively guided to move along the circular path CP and the reciprocating path RP1, and another predetermined portion (hereinafter "third portion 566") of each supporting member 560 is restricted to move along a first closed path CP1 with respect to the frame 510. In other words, while the third portion 566 of each supporting member 560 moves along the first closed path CP1, the upper end of the supporting member 560 rotates along the circular path CP and the lower end of the supporting member 560 reciprocates along the reciprocating path RP1. In the preferred embodiment of the present invention, the third portion 566 is defined between the upper end and the lower end of each supporting member 560. The third portion 566 of each supporting member 560 is positioned at a front side of a connection line between the upper end and the lower end of the supporting member 560 in a side view. According to the spatial relationship of the parts, the rotational direction of the upper end of each supporting member 560 along the circular path CP corresponds to the direction of movement of the third portion 566 along the first closed path CP1. For example, when the upper end of each supporting member 560 is rotated in a counterclockwise direction along the circular path (namely move downward at the front semi-circular arc and move upward at the rear semi-circular arc), the third portion 566 is moved downward at the front half part of the first closed path CP1 and moved upward at the rear half part of the first closed path CP1 as well. In the movement period of the upper end of each supporting member 560 rotating along the circular path CP, the first portion (namely the upper end) of each supporting member 560 is always kept higher than the third portion 566 of the supporting member 560, of course higher than the second portion (namely the lower end) of the supporting member 560. The first closed path CP1 is substantially elongated elliptical or fusiform in shape and the acute included angle between its major axis direction and the horizontal plane is greater than 45 degrees. In the preferred embodiment of the present invention, an upper point of the first closed path CP1 is located more forward than a lower point of the first closed path CP1. Specifically, the elevation angle of the upper point relative to the lower point of the first closed path CP1 is about 65 degrees.

The exercise apparatus 500 further comprises symmetrical left and right upper swing members 570 and left and right control links 580. The left and right upper swing members 570 are arranged above the crank mechanism 520. Each of the two upper swing members 570 has an axial portion 572, a connecting portion 574. The axial portion 572 is pivotally connected to the upper end of the support frame 514 at a third axis (not shown). The connecting portion 574 is located rearward relative to the axial portion 572, which is capable of swinging up and down about the axial portion 572. Each of the two control links 580 is a substantially L-shaped bending rod, which has a pivot portion 582, a restricted portion 584 and a supporting portion. The pivot portion 582 of each control link 580 is mounted to the third portion 566 of the corresponding supporting member 560, so that the control link 580 and the supporting member 560 at the same side could be pivotally rotated about the pivot portion 582/third portion 566, and the pivot portion 582 of each control link 580 moves together with the third portion 566 of the corresponding supporting member 560 along the first closed path CP1. The restricted portion 584 is defined at the upper end of each control link 580. The restricted portion 584 of each control link 580 is pivotally connected to the connecting portion 574 of the corresponding upper swing member 570, so that the restricted portion 584 is moved within an arc-shaped restricted path RP2 guided by the corresponding upper swing member 570 with respect to the frame 510. On the other hand, the lower portion of each the control link 580 extended rearward to form the supporting portion for supporting a user's feet and bearing the force applied by the user. In the preferred embodiment, two pedals 590 are respectively attached to the supporting portions of the control links 580 for allowing a user to step on. Each of the two pedals 590 regards as one part of the supporting portion, which has a toe end and a heel end opposite to each other. The supporting portion (including the pedal) of each control link 580 is located at the rear of the pivot portion 582 relatively, and the height of the supporting portion substantially corresponds to the height of the lower end of the corresponding supporting member 560.

Since the distance and the relationship between the pivot portion 582, the restricted portion 584 and the supporting portion (represented by the pedal 590 hereinafter) of each control link 580 are constant, based on the appropriate component size and location relationship, when the pivot portion 582 of each control link 580 moves along the first closed path CP1, a position of the restricted portion 584 within the restricted path RP2 is determined by a position of the pivot portion 582 of the corresponding control link 580 within the first closed path CP1 so as to determine a position and an angle of the pedal 590 with respect to the frame 510. When the pivot portion 582 of each control link 580 moves along the first closed path CP1, the restricted portion 584 is reciprocated between a top end and a bottom end of the arc-shaped restricted path RP2. At the same time, a specific part of the pedal 590 (such as the center of the pedal) cyclically moves along a second closed path CP2, and the angle of the heel end relative to the toe end is changed cyclically. The movement direction of the pedal 590 along the second closed path CP2 will correspond to the movement direction of the pivot portion 582 of the corresponding control link 580 along the first closed path CP1, namely the movement direction corresponds to the rotational direction of the upper end of the corresponding supporting member 560 along the circular path CP. Specifically, an acute included angle between a connection line of the upper end point and the lower end point of the restricted path RP2 and a horizontal plane (e.g. a ground) is greater than 45 degrees. In the preferred embodiment, the elevation angle of the upper end point relative to the lower end point of the restricted path RP2 is about 49 degrees.

Figure 27:
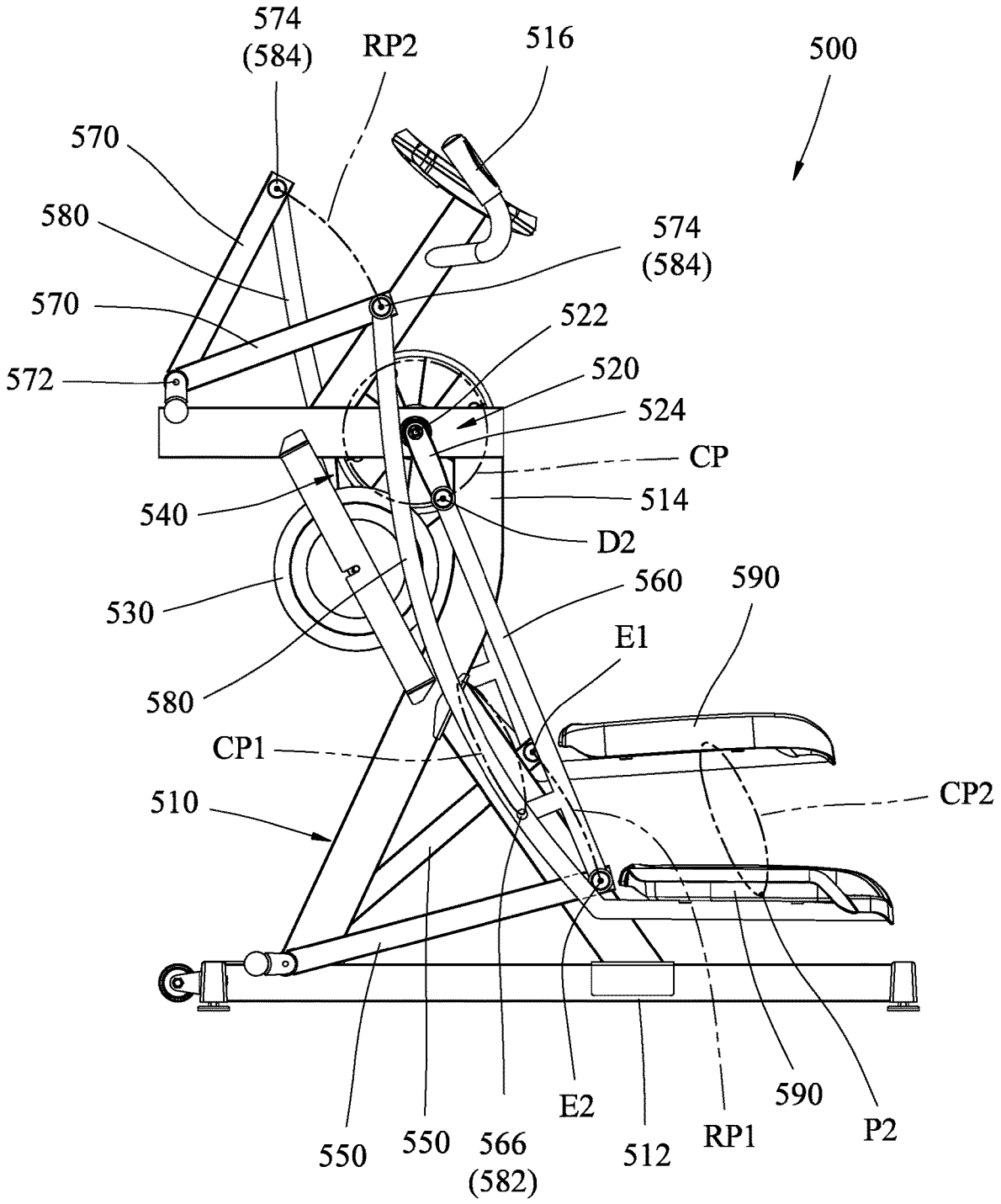
FIG. 27 through FIG. 30 show a fifth embodiment of a stationary exercise device in accordance with the present invention in a left side view.
Figure 28:
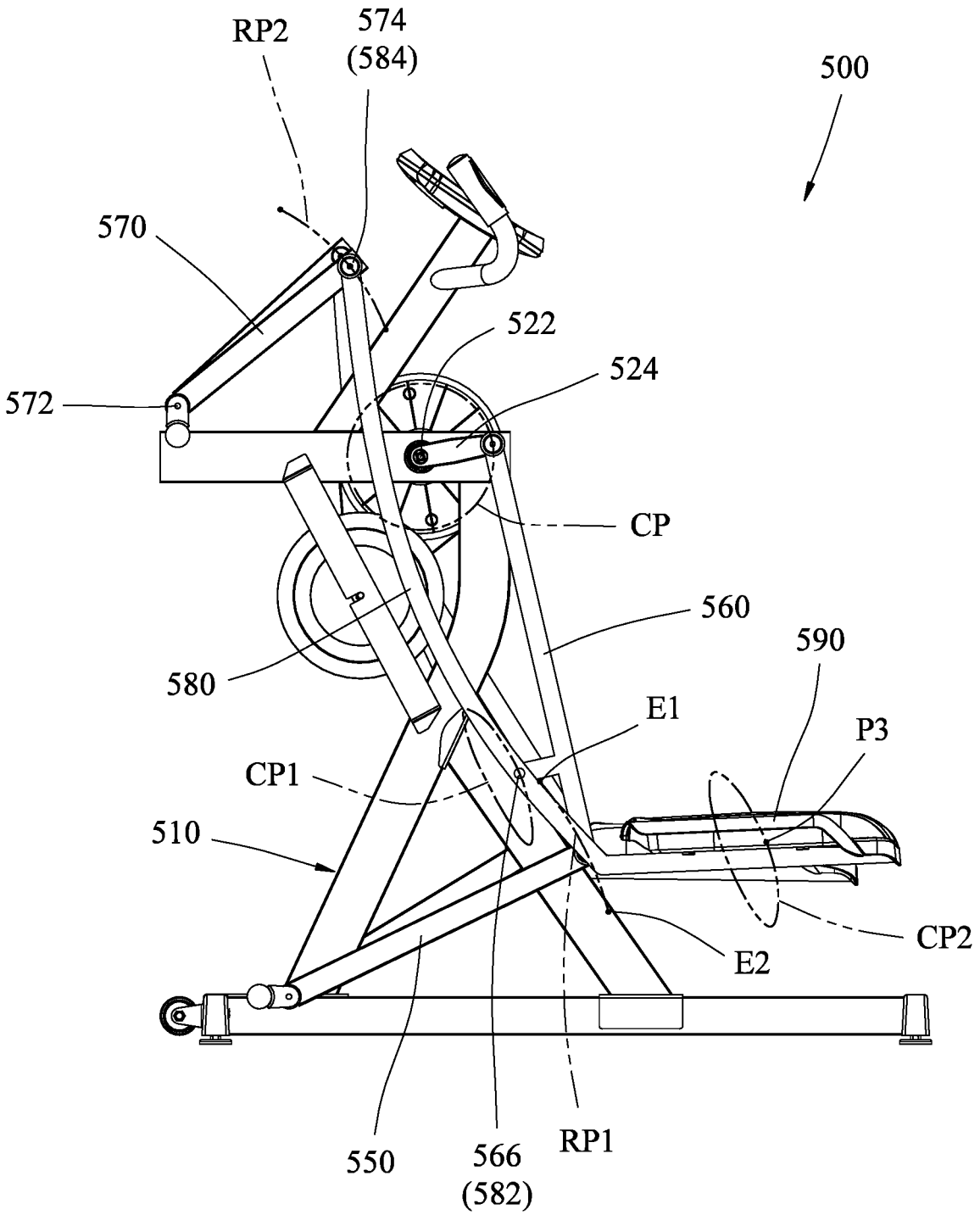
Figure 29:
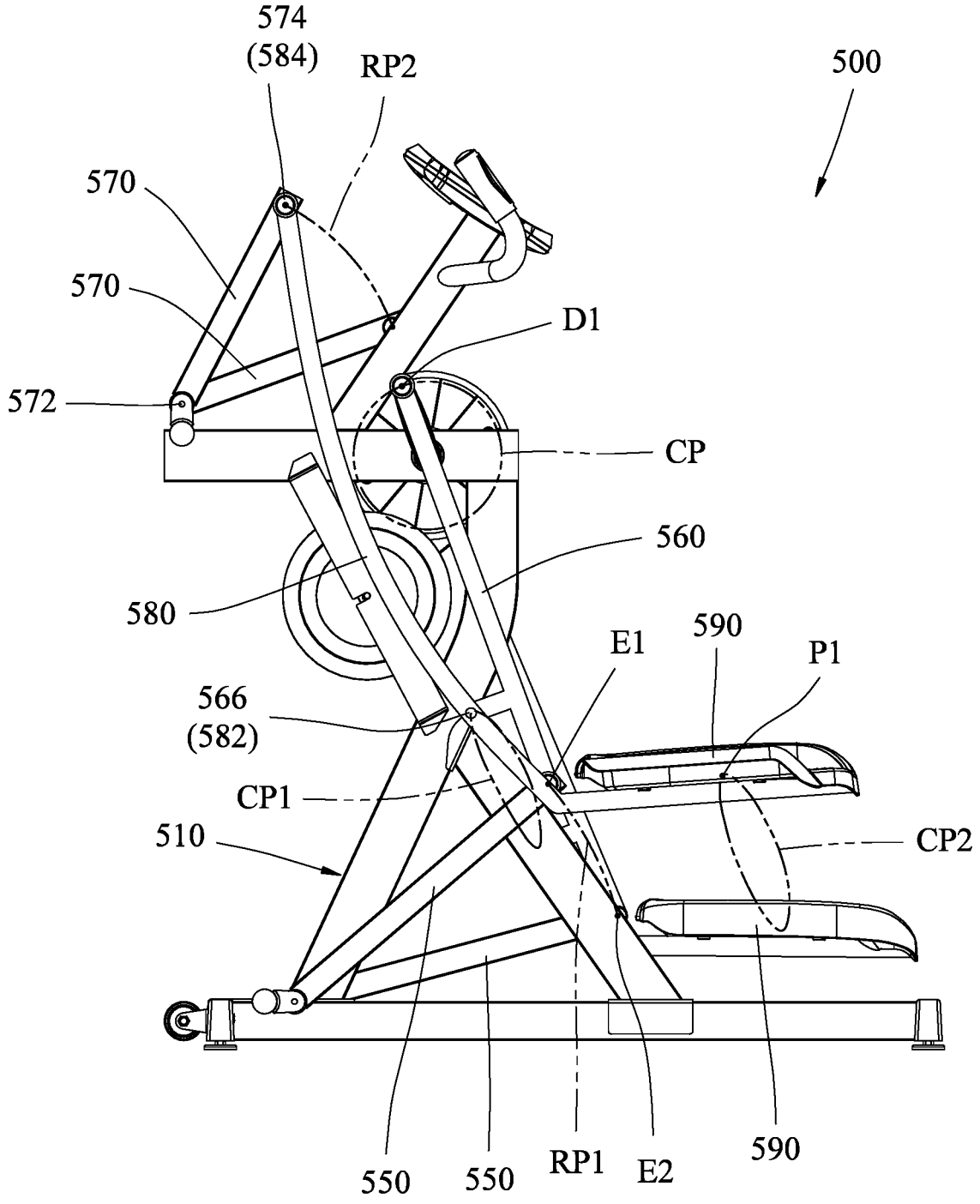
Figure 30:
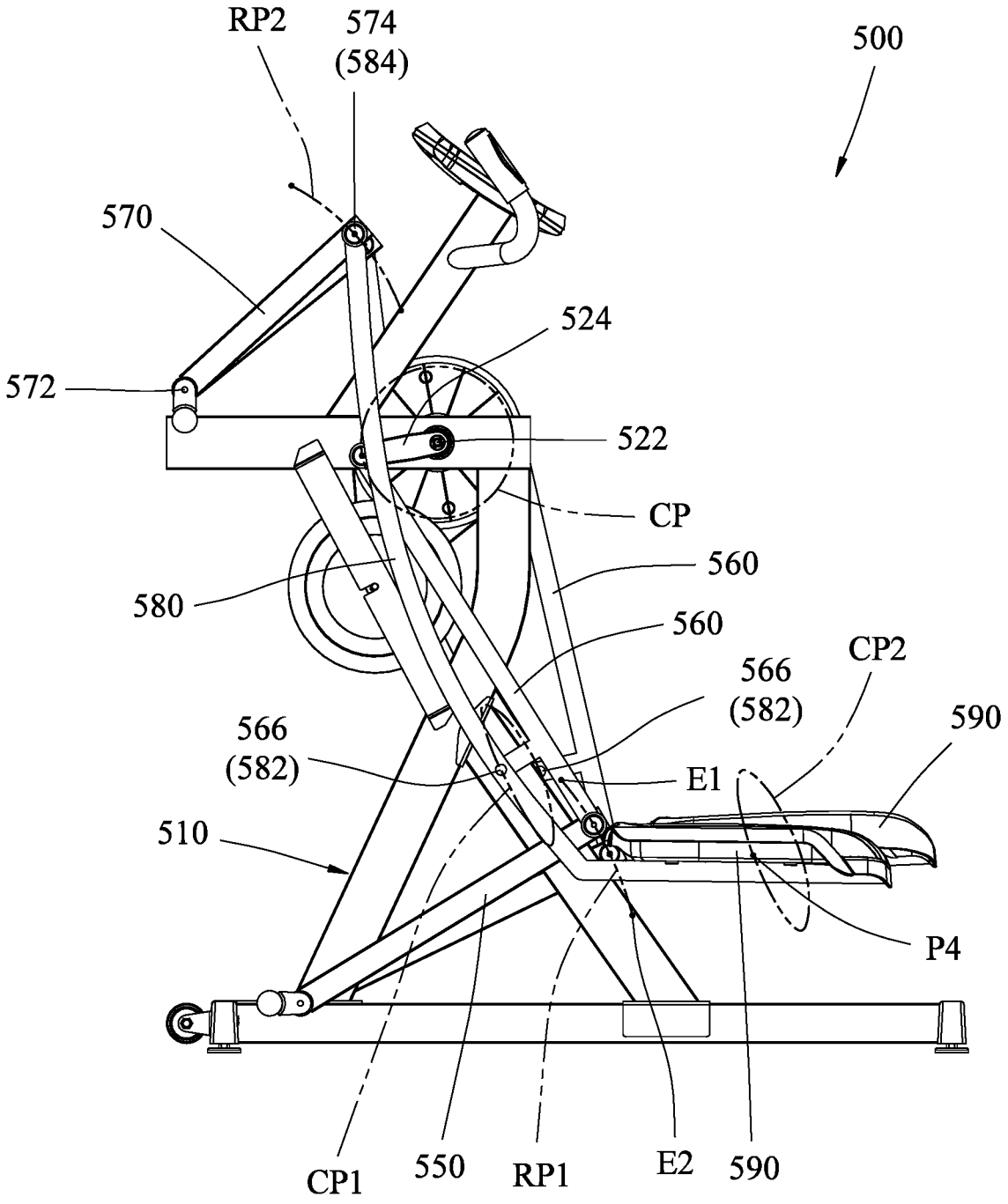
Figure 31:
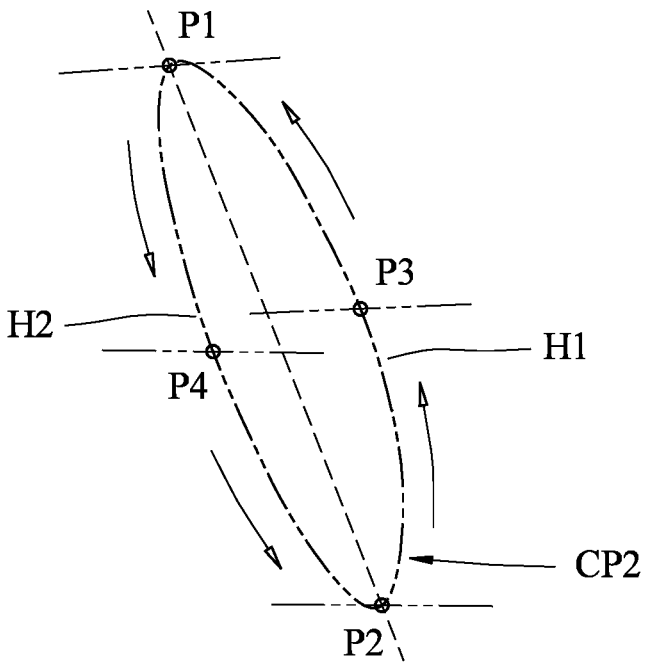
FIG. 31 illustrates the pedals move along a second closed path.

Furthermore, the second closed path CP2 is located below the lowermost point of the circular path CP, which is substantially elongated elliptical or fusiform in shape. As shown in FIG. 29, when the upper end and the lower end of each supporting member 560 are respectively positioned at the first dead point D1 of the circular path CP and the first end point E1 of the reciprocating path RP1, the third portion 566 of the supporting member 560, together with the pivot portion 582 of the corresponding control link 580, is located substantially at the top end of the first closed path CP1, such that the restricted portion 584 of the corresponding control link 580 is substantially located at the top end of the restricted path RP2, and the pedal 590 is correspondingly located at an upper point P1 of the second closed path CP2. The heel end of the pedal 590 is positioned relative to the toe end at a first height (e.g. the inclined angle of the pedal 590 is about 4 degrees). In contrast, as shown in FIG. 27 and FIG. 31, when the upper end and the lower end of each supporting member 560 are respectively positioned at the second dead point D2 of the circular path CP and the second end point E2 of the reciprocating path RP1, the third portion 566 of the supporting member 560, together with the pivot portion 582 of the corresponding control link 580, is located substantially at the bottom end of the first closed path CP1, such that the restricted portion 584 of the corresponding control link 580 is substantially located at the bottom end of the restricted path RP2, and the pedal 590 is correspondingly located at an lower point P2 of the second closed path CP2. The heel end of the pedal 590 is positioned relative to the toe end at a second height (e.g. the pedal 590 is substantially horizontal), which is lower than the first height. The upper point P1 is located more forward than the lower point P2, and a direction of connection of the upper point P1 and the lower point P2 is defined as a major axis direction of the second closed path CP2, and an acute included angle between the major axis direction and the horizontal plane is greater than 45 degrees, and in the preferred embodiment is about 68 degrees. Besides, the second closed path CP2 defines a minor axis direction perpendicular to the major axis direction, and the maximum width of the second closed path CP2 in the minor axis direction is smaller than a half of a linear distance between the upper point P1 and the lower point P2. Furthermore, a vertical distance between an uppermost point and a lowermost point of the second closed path CP2 is greater than a horizontal distance between a foremost point and a rearmost point of the second closed path CP2. In other words, in the period of the two pedals 590 moving along the second closed path CP2, the vertical distance that the pedals 590 travel up and down will be greater than the horizontal distance of the forward and backward motion of the pedals 590.

As shown in FIG. 31, the second closed path CP2 is divided into a first half part H1 at the rear side thereof and a second half part H2 at the front side thereof according to the upper point P1 and the lower point P2, and a middle point P3 of the first half part H1 is located more rearward than a middle point P4 of the second half part H2. When the pedal 590 is located at the middle point P3 of the first half part H1, the heel end of the pedal 590 is positioned relative to the toe end at a third height (e.g. the inclined angle is about 3 degrees), which is higher than the second height. When the pedal 590 is located at the middle point P4 of the second half part H2, the heel end of the pedal 590 is positioned relative to the toe end at a fourth height (e.g. the inclined angle is about −1 degrees), which is lower than the first height. Therefore, when the pedal 590 is moved upward along the first half part H1 of the second closed path CP2 and moved downward along the second half part H2 of the second closed path CP2, the heel end of the pedal 590 is raised relative to the toe end in the first half of the raising period such as moving upward from the lower point P2 to the middle point P3 of the first half part H1; in contrast, the heel end of the pedal 590 is lowered relative to the toe end in the first half of the lowered period such as moving downward from the upper point P1 to the middle point P4 of the second half part H2.

The upper ends of the left and right supporting members 560 are maintained at 180 degrees relative to each other on the circular path CP. The pivot portions 582 of the left and right control links 580 are also substantially kept opposite to each other on the first closed path CP1. Correspondingly, the left and right pedals 590 are substantially kept opposite to each other on the second closed path CP2 as well. For example, when one of the two pedals 590 is located at the top/bottom of the second closed path CP2, the other pedal 590 is located approximately at opposite bottom/top of the second closed path CP2. Besides, assuming the upper ends of the supporting members 560 rotate in a counterclockwise direction along the circular path CP, then, when one of the two pedals 590 is moved forward and upward along the first half part H1 of the second closed path CP2, the other pedal 590 is moved rearward and downward along the second half part H2 of the second closed path CP2.

When using the exercise apparatus 500, the user can step on the left and right pedals 590 with two legs and grip fixed handles 516 mounted on the upper end of the support frame 514 with two hands, and using both feet to alternately tread the left and right pedals 590, so that the left and right pedals 590 could be cyclically moved along the second closed path CP2 and kept opposite to each other. Therefore, the user is able to perform a leg exercise that two legs are alternately moved up and down.

In the preferred embodiment of the present invention, the crank mechanism 520 is defined as a first guiding mechanism mounted to the frame 510 for guiding the first portions of the two supporting members 560 to move along the circular path CP about the first axis with respect to the frame 510. The two lower swing members 550 are defined as a second guiding mechanism mounted to the frame 510 for guiding the second portions of the two supporting members 560 to move along the reciprocating path RP1 with respect to the frame 510. The two upper swing members 570 are defined as a third guiding mechanism mounted to the frame 510 for guiding the restricted portions 584 of the two control links 580 to move along the restricted path RP2 with respect to the frame 510. However the guiding mechanisms may be achieved in other manners to reach above guiding paths.

In the fifth embodiment of the present invention, the angular change behavior and range of the control links 580 may be determined by the relative relationship between the restricted path RP2 and the first closed path CP1 during the movement cycle, and there is no certain relationship with the angular change behavior and the raising range of the supporting members 560, so that the exercise apparatus 500 is capable of taking movement stroke and angular changing range of longer pedals or shorter pedals into consideration, and it is relatively easy to optimize the angle change behavior of the pedals.

When using the exercise apparatus 500 to perform the leg exercise, the pedals 590 may be cycled in such a way as to be moved upwardly along the first half part H1 of the second closed path CP2 and moved downwardly along the second half part H2 of the second closed path CP2, or to be moved upwardly along the second half part H2 of the second closed path CP2 and moved downwardly along the first half part H1 of the second closed path CP2. In short, by an appropriate shape of the second closed path CP2, the leg exercise can include movements of the legs to stride forward and move backward.

As mentioned previously, when the pedals 590 are moved cyclically along the second closed path CP2, if the pedals 590 are moved upward along the first half part H1 and downward along the second half part H2, the heel end of each pedal 590 is raised relative to the toe end in the first half of the raising period such as moving upward from the second height to the third height, and the heel end of each pedal 590 is lowered relative to the toe end in the first half of the lowered period such as moving downward from the first height to the forth height.

In the preferred embodiment of the present invention, the exercise apparatus 500 is designed for allowing the user to naturally drive the pedals 590 to move in a predetermined rotational direction, namely unless the user deliberately controls the force mode, the pedals 590 are usually moved upward along the first half part H1 of the second closed path CP2 and lowered downward along the second half part H2 of the second closed path CP2, such rotational direction is more consistent with the natural motion of the legs. In general, when one user moves away from the exercise apparatus 500, the pedal on one side (e.g. the left side pedal) may be located approximately at the lowermost position of the second closed path CP2, and the pedal on the other side (e.g. the right side pedal) is located approximately at the uppermost position of the second closed path CP2, and therefore when the next user wants to use the exercise apparatus 500, the user may naturally step on the left side pedal near the lowermost position with the left foot, and raise the right foot to step on the right pedal near the uppermost position, then, the right leg forces the right side pedal to move downward while the left side pedal is raised correspondingly so as to begin alternating movements of the left and right pedals. At the beginning, the left side pedal 590 is located substantially at the lowermost of the second closed path CP2, namely the upper end of the left side supporting member 560 is located near the second dead point D2 at the rear lower quarter arc of the circular path CP. At the same time, the upper end of the right side supporting member 560 is located at the front upper quarter arc of the circular path CP, and located below the first dead point D1. When the right foot treads the right pedal 590 downwardly, the force is applied to the third portion 566 of the right side supporting member 560 via the pivot portion 582 of the right control link 580, since the third portion 566 is positioned at a front side of a straight line passing through both the upper end and the lower end of the corresponding supporting member 560, the downward force acting on the third portion 566 will cause the lower end of the right supporting member 560 to move downward.

In another embodiment of the present invention, the lower end of each supporting member 560 could be adjusted to connect to the rod body of the corresponding lower swing member 550 between two ends.

Figure 32:
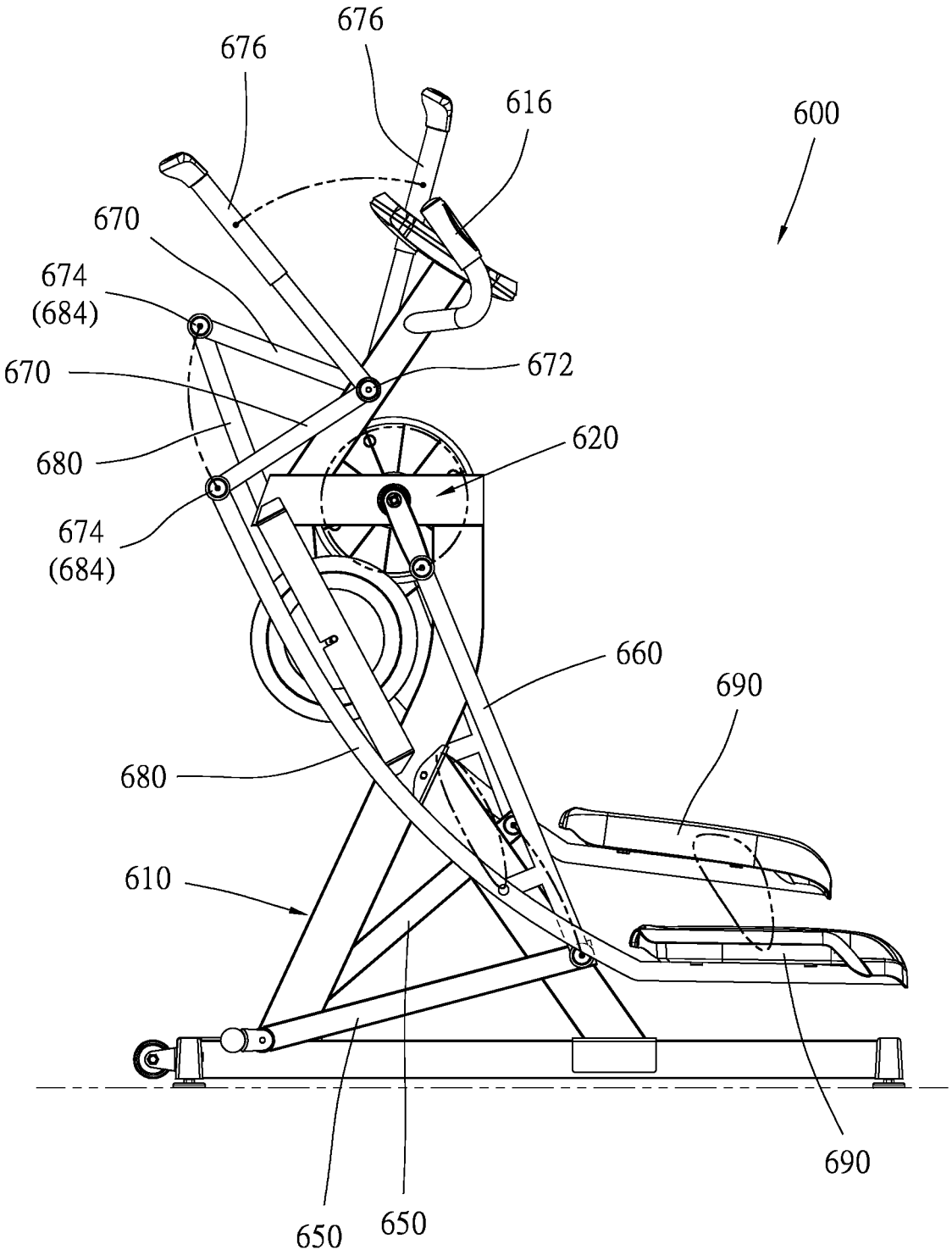
FIG. 32 is a side view of a sixth embodiment of a stationary exercise device in accordance with the present invention.

FIG. 32 shows an exercise apparatus 600 in accordance with a sixth embodiment of the present invention. The sixth embodiment is similar to the fifth embodiment, including a frame 610, a crank mechanism 620, two lower swing members 650, two supporting members 660, two upper swing members 670, two control links 680 and two pedals 690, except that each upper swing member 670 has an axial portion 672, a connecting portion 674 and a gripping portion 676. The axial portion 672 is pivotally mounted to the upper portion of the frame 610, and the connecting portion 674 is located in front of the axial portion 672 so that the connecting portion is able to swing up and down about the axis of the axial portion 672. The gripping portion 676 is arranged above the axial portion 672, which is able to swing forward and backward about the axis of the axial portion 672.

In operation, for example, when the left side pedal 690 is moved downward and the right pedal 690 is moved upward, the left gripping portion 676 is swung forward correspondingly, namely away from the left side pedal 690 because the movement of the restricted portion 684 of the left control link 680 drives the connecting portion 674 of the left upper swing member 670 to swing downward, at the same time, the right gripping portion 676 is swung backward correspondingly, namely close to the right side pedal 690 because the movement of the restricted portion 684 of the right control link 680 drives the connecting portion 674 of the right upper swing member 670 to swing upward. Accordingly, the left and right side pedals 690 are moved up and down alternately, and the left and right gripping portions 676 are swung backward and frontward alternately at the same time.

When using the exercise apparatus 600, the user can step on the left and right pedals 690 and grip the left and right gripping portions 676, have both feet to alternately tread the left and right pedals 690 and both hands to alternately push and pull the left and right gripping portions 676, so that the left and right pedals 690 could be cyclically moved along a closed path for performing leg exercise that two legs are alternately moved up and down and performing hand exercise that two hands are alternately moved forward and backward. The user can also choose to grip fixed handles 616 that is mounted on the upper end of the frame 610, namely not to perform hand movement.

What is claimed is:

1. A stationary exercise apparatus, comprising:

a frame;

two supporting members, each supporting member having a first end portion and a second end portion, the first end portions of the two supporting members respectively coupled to the frame to rotate about a first axis;

two swing members, each swing member having a first end and a second end, the first ends of the two swing members respectively pivotally connected to the frame, the second ends of the two swing members respectively pivotally joined to the second end portions of the two supporting members, so that the second end of each swing member is swingable with respect to the first end; and two pedals respectively coupled to the two supporting members, the two pedals moving along a closed path while the first end portions of the two supporting members are being rotated about the first axis and the second end portions of the two supporting members are reciprocating with the second ends of the two swing members.

2. The stationary exercise apparatus as claimed claim 1, further comprising two control links pivotally connected to the respective supporting members, each control link having a first portion, a second portion, and a third portion, wherein the first portions of the two control links are movably coupled to the frame, the third portions of the two control links are respectively joined to the respective supporting members, the two pedals are respectively coupled to the second portions of the two control links and moving along the closed path.

3. The stationary exercise apparatus as claimed claim 1, wherein the second end portions of the two supporting members define a reciprocating path having a first end point and a second end point, the first end point being located higher than the second end point, the position of the first end point being more forward than the position of the second end point.

4. The stationary exercise apparatus as claimed claim 3, wherein the first end portions of the two supporting members are moved along a circular path about the first axis, the reciprocating path of the second end portions of the two supporting members being located below the circular path of the first end portions of the two supporting members.

5. The stationary exercise apparatus as claimed claim 2, further comprising two upper swing members, each of the two upper swing members having an axial portion, a connecting portion and at least one gripping portion, the axial portion pivotally mounted to the frame, the connecting portion connected to the first portion of the corresponding control link for guiding the first portion of the corresponding control link to move along a restricted path about the axial portion, the at least one gripping portion being able to swing forward and backward about an axis of the axial portion for allowing a user to grip.

6. The stationary exercise apparatus as claimed claim 5, wherein the restricted path having a major axis at an angle of greater than 45 degrees to horizontal.

* * * * *